US007429961B2

(12) United States Patent
Sievenpiper et al.

(10) Patent No.: US 7,429,961 B2
(45) **Date of Patent: *Sep. 30, 2008**

(54) METHOD FOR FABRICATING ANTENNA STRUCTURES HAVING ADJUSTABLE RADIATION CHARACTERISTICS

(75) Inventors: Daniel F. Sievenpiper, Santa Monica, CA (US); Hui-Pin Hsu, Northridge, CA (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/326,881

(22) Filed: Jan. 6, 2006

(65) Prior Publication Data

US 2007/0159395 A1 Jul. 12, 2007

(51) Int. Cl.
*H01Q 15/02* (2006.01)

(52) U.S. Cl. ..... 343/909; 343/700 MS

(58) Field of Classification Search ..... 343/700 MS, 343/909

See application file for complete search history.

(56) References Cited

U.S. PATENT DOCUMENTS

| | | | | |
|---|---|---|---|---|
| 5,917,458 | A | 6/1999 | Ho et al. | |
| 6,147,572 | A | 11/2000 | Kaminski et al. | 333/134 |
| 6,366,254 | B1 | 4/2002 | Sievenpiper et al. | |
| 6,433,756 | B1 | 8/2002 | Sievenpiper et al. | |
| 6,512,494 | B1 | 1/2003 | Diaz et al. | |
| 6,545,647 | B1 | 4/2003 | Sievenpiper et al. | |
| 6,768,476 | B2 | 7/2004 | Lilly et al. | |
| 6,917,343 | B2 * | 7/2005 | Sanchez et al. | 343/795 |
| 7,071,889 | B2 * | 7/2006 | McKinzie et al. | 343/756 |
| 7,190,325 | B2 | 3/2007 | Nagy | 343/909 |
| 2003/0011522 | A1 | 1/2003 | McKinzie, III et al. | |
| 2004/0075617 | A1 | 4/2004 | Lynch et al. | |
| 2006/0077101 | A1 | 4/2006 | Puente Ballarda et al. | 343/700 MS |
| 2006/0227422 | A1 | 10/2006 | Monacelli et al. | 359/485 |

FOREIGN PATENT DOCUMENTS

| | | |
|---|---|---|
| EP | 1508940 | 2/2005 |

* cited by examiner

*Primary Examiner*—Tho G Phan

(57) ABSTRACT

The radiation properties and wave guiding properties of frequency selective surfaces are used in conjunction with closely spaced antenna elements to fabricate antenna structures having adjustable radiation characteristics. The direction, magnitude, and polarization of radiation patterns for such antenna structures can be adjusted by varying the texture or patterning of layers of conducting material forming the frequency selective surfaces. The invention enables the fabrication of low profile antenna structures that can easily be conformed or integrated into complex surfaces without sacrificing antenna performance.

18 Claims, 19 Drawing Sheets

METHOD FOR FABRICATING ANTENNA STRUCTURES HAVING ADJUSTABLE RADIATION CHARACTERISTICS

CROSS REFERENCE TO RELATED APPLICATIONS

The present invention is related to commonly assigned and co-pending U.S. patent application Ser. No. 11/327,122 filed on even date herewith, the contents of which are incorporated herein by reference.

TECHNICAL FIELD

The present invention is related to antennas, and more particularly to antenna structures utilizing frequency selective surfaces for the adjustment of antenna radiation characteristics.

BACKGROUND OF THE INVENTION

Over the past several years, the number of different information and entertainment (infotainment) services available for automotive use has dramatically increased. These services include AM/FM radio, cellular phones, GPS navigation, satellite radio, remote keyless entry, remote vehicle starting, and others. Each of these services typically requires that a separate and distinct antenna be mounted on automotive vehicles.

Different antenna structures have been proposed to support the growing number of services, such as antennas formed by depositing conductive films, strips, or wires on vehicle windows, and apertures created in the metallic structure of vehicles. In order to make these antennas less conspicuous and preserve vehicle aesthetics and aerodynamics, it is often necessary to sacrifice antenna performance.

Accordingly, there exists a need for low profile antenna structures, which can be conformed easily to complex surfaces such as those found on automobiles, without sacrificing antenna performance.

SUMMARY OF THE INVENTION

Frequency selective surfaces (FSSs) have been used in the past as spatial filters for propagating electromagnetic waves. A FSS is typically formed as a thin patterned layer of conducting material containing a plurality of apertures, or separated conductive elements, which define the patterning or surface texture of the FSS. The patterned layer of conducting material is often formed on a layer of dielectric material to provide additional support. It is known that by adjusting the size, shape, and spacing of the apertures or separate conducting elements, the electromagnetic properties of FSSs can be modified.

The applicants for the present invention have found that FSSs can be advantageously used to fabricate antenna structures having adjustable radiation characteristics. Broadly, this is accomplished by utilizing a FSS, which includes a patterned layer of conducting material having electromagnetic properties that vary as a function of frequency. An antenna element operating at a selected frequency is position proximate to the FSS to promote near field coupling of electromagnetic energy between the antenna element and the patterned layer of conducting material. The applicants have found that by structuring the patterned layer of conducting material to have specific electromagnetic properties at the selected frequency of operation of the antenna element, predetermined adjustments can be made to the radiation characteristics of the antenna structure. The direction, magnitude, and polarization of the radiation patterns of such antenna structures can be adjusted by varying the pattering or texture of the layer of conducting material forming the FSS.

Accordingly, the invention enables the fabrication of low profile antenna structures that can easily be conformed or integrated into complex surfaces. These aspects along with ability to adjust the radiation patterns of these antenna structures to accommodate their surrounding environment, makes their application particularly attractive for use on automotive vehicles.

BRIEF DESCRIPTION OF THE DRAWINGS

The present invention will now be described, by way of example, with reference to the accompanying drawings, in which.

Figure 1:
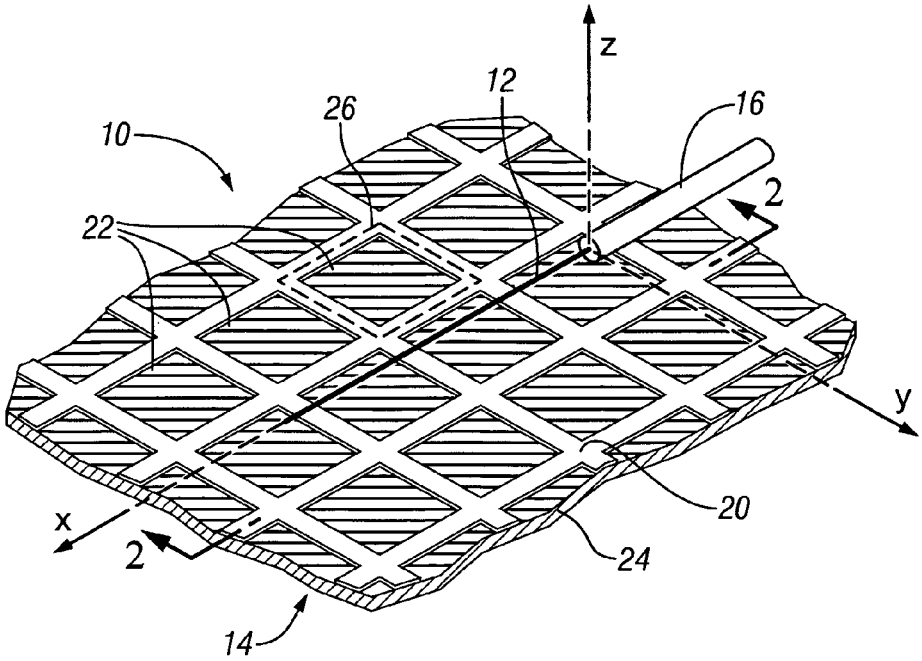
FIG. 1 is a perspective view showing a fragmented portion of a FSS positioned within the near field of an antenna element to form a antenna structure having various features of the present invention.

It will be appreciated that for simplicity and clarity of illustration, elements illustrated in the figures have not necessarily been drawn to scale. For example, the dimensions of some elements are exaggerated relative to the dimensions of other elements for clarity. Further, where considered appropriate, reference numerals have been repeated among the figures to indicate corresponding or analogous elements.

DESCRIPTION OF THE PREFERRED EMBODIMENT

With reference first to FIG. 1, there is shown an antenna structure formed according to the present invention, which is designated generally as numeral 10. Antenna structure 10 includes an antenna element 12, positioned proximate a fragmented section of a frequency selective surface (FSS), generally designated as 14. For the embodiment of FIG. 1, FSS 14 is illustrated as being a planar surface; however, FSS 14 can also take the form of a curved surface or non-planar surface, as later described in the specification. The x, y, and z-axes of a rectangular coordinate system are also shown in FIG. 1, which will be used here, and throughout the specification for directional reference.

In this embodiment, antenna element 12 takes the form of a linear wire monopole antenna formed by the center wire conductor of coaxial cable 16, which is exposed after removing a portion of the shielding and outer cable covering. Antenna element 12 is shown as an elongate wire with its longitudinal axis extending essentially parallel to the surface of FSS 14 in a direction along the x-axis of the imposed rectangular coordinate system.

For the purpose of illustrating this embodiment, FSS 14 includes a patterned layer of conducting material 20 in the form of a conducting sheet containing a plurality of square shaped apertures 22. The dashed box outline 26, contains one such aperture 22, and represents what is commonly referred to as a unit cell of the FSS 14. The pattern of the unit cell is typically repeated in adjoining fashion over the surface of the layer of conducting material 20, which in this case forms the uniformly spaced array of square apertures 22.

FSS 14 is shown further including a substrate in the form of a dielectric layer 24 attached to the patterned layer of conducting material 20. In this embodiment, patterned layer of conducting material 20 would be self supporting, and dielectric layer 24 is not necessarily required; however, for embodiments to be later described, where the patterned layer of conducting material 20 comprises a plurality of separate conductive elements, rather than apertures, some form of supporting dielectric layer will be present.

For ease of description, the same numeral 20 will be used at different points in the specification to denote a patterned layer of conducting material, independent of different unit cell structures that will be used to pattern the surface of the layer of conducting material 20. Likewise, for simplicity of description, the numeral 14 will be used to designate FSSs having the different patterned layers of conducting material as long as the patterning is the primary distinguishing feature.

FSS 14 can be fabricated by removing material from a thin conductive sheet of material such as copper to form the desired patterned layer of conducting material 20. Alternatively, a sheet of conductive material such as copper foil can be attached to a dielectric layer made of acrylic or other electrically non-conducting material, and portions can then be cut and removed from the copper sheet to form the patterning of its surface. Other well known techniques can also be applied to form patterned layer of conducting material 20, as for example, vapor deposition or plating of conductive material on dielectric layer 24, followed by patterned chemical etching such as used in fabricating printed circuit boards.

Figure 2:
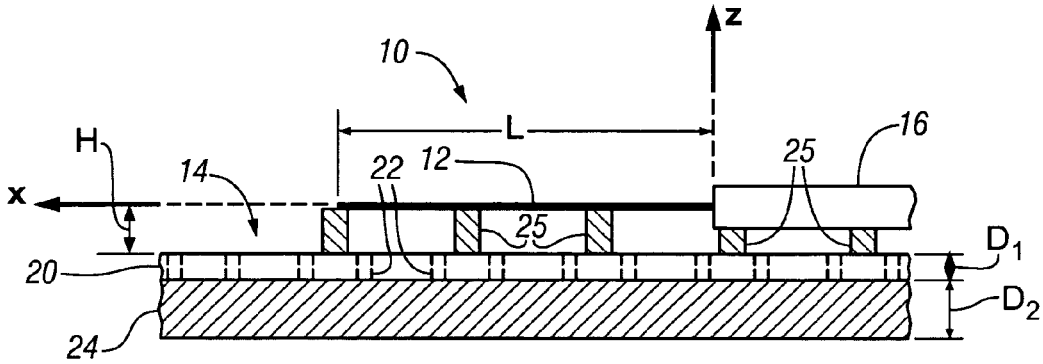
FIG. 2 is a cross-sectional view of the antenna structure of FIG. 1 taken along line 2-2, which shows additional detail regarding insulating supports between the antenna element and FSS.

Turning now to FIG. 2, there is shown a cross-sectional view of the antenna structure 10 illustrated in FIG. 1, taken along line 2-2. Note that additional detail is included regarding the introduction of supporting posts 25 for positioning the monopole antenna element 12 relative to the patterned layer of conducting material 20. These supporting posts 25 can be formed of any non-conducting material, such as plastics or other dielectric substance, and attached by adhesive to antenna element 12, coaxial cable 16, patterned layer of conducting material 20, and/or dielectric layer 24, thereby fixing the position of antenna element 12 relative to FSS 14. It will be understood that instead of using discrete supporting posts 25 attached to FSS 14, a partial or complete layer of non-conductive material or dielectric can be applied to the surface of FSS 14 to space antenna element 12 and coaxial cable 16 from patterned layer of conducting material 20.

Because the efficiency of an antenna improves at resonance, the length L of the linear wire monopole antenna element 12 is preferably selected to be approximately $\lambda/4$, where $\lambda$ represents the free space wavelength at the selected frequency of operation of antenna element 12; however, antenna element 12 will function with decreased efficiency where the length L is not selected to produce resonance. Antenna element 12 is also shown positioned at a distance H from the patterned layer of conducting material 20. Preferably, this distance H is selected to promote near field inductive coupling between antenna element 12, and the patterned layer of conducting material 20.

The distance from an antenna at which the near field predominates over the far field radiation depends upon the structure and dimensions of the particular antenna. For a monopole having a length short, as compared to a wavelength at its frequency of operation, it is known that the relative strengths of the near and far fields are essentially equal a distance of approximately $\lambda/2\pi$ in directions perpendicular to the length of the short monopole. This result is applicable to the monopole antenna element 12 used in the present embodiment, even though it was selected to have a length near $\lambda/4$. Consequently, the distance H is preferably less than about $\lambda/2\pi$ to promote increased near field inductive coupling between antenna element 12 and the patterned layer of conducting material 20 of FFS 14. The thickness $D_1$ of the patterned layer of conducting material 20 is typically at least two or three times the electromagnetic skin depth for the conducting material at the frequency of operation of antenna element 10, to avoid excessive resistive loss. However, the layer of conducting material can also be formed from known thin transparent conductive films for applications where additional resistive loss can be tolerated.

Those skilled in the art will recognize that the presence of dielectric layer 24 has the effect of reducing the electrical length of the unit cell 26, and the various dimensions of the associated aperture (or alternative conducting element) contained in the unit cell 26, which acts to shift the electromagnetic behavior of FSSs formed by such cells upward in frequency as compared to a FSS having no dielectric layer 24. The amount of frequency shift will depend to some degree upon the thickness of the layer $D_2$ and the relative dielectric constant of the material forming the dielectric layer 24.

Figure 3:
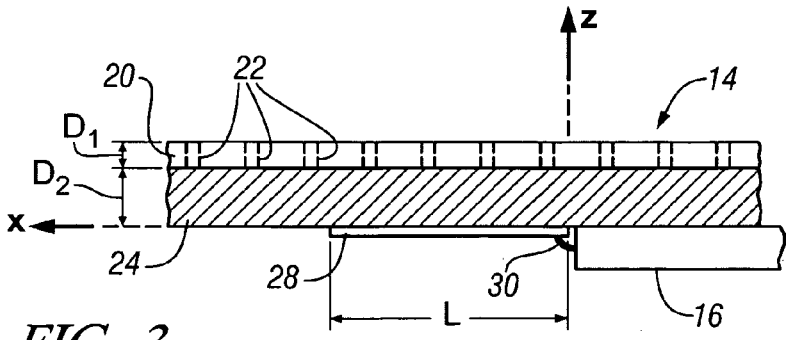
FIG. 3 is a view similar to FIG. 2, but showing an alternative structure and position for the antenna element relative to the FSS.

FIG. 3 shows an alternative embodiment for the antenna structure of the present invention. In this embodiment, an antenna element 28 is positioned directly on the surface of dielectric layer 24, which is opposite the surface in contact with patterned layer of conducting material 20. For this embodiment, the thickness $D_2$ of dielectric layer 24 is preferably less than about $\lambda/2\pi$, in order to enhance near field inductive coupling between the antenna element 28 and patterned layer of conducting material 20.

Antenna element 28 takes the form of a thin narrow conducting strip having a longitudinal axis in a direction essentially parallel to the surface of FSS 14. Antenna element 28 can be electrically attached, for example by soldering, to a short length of the center conductor 30 of coaxial cable 16, all of which can be attached by adhesive, plating, or other know means to dielectric layer 24. In this form, antenna element 28 is known in the art as a tab monopole, which generally has increased operating bandwidth near resonance, as compared to a thin wire monopole antenna element 12. Antenna element 28 has thickness (in the z-direction) sufficient to avoid excessive resistive loss, and a width (in the y-direction) that can be up to about $\lambda/10$ to insure current flow primarily along its length in the x-direction. As long as antenna elements 12 and 28 have similar lengths L, they will behave similarly, and can easily be interchanged in their respective applications shown in FIGS. 2 and 3.

For purposes of illustration, coax cable 16 has been shown as the means for feeding antenna elements 12 and 28. As will be understood by those skilled in the art, a variety of other feeding structures could also be used, as for example, transmission lines formed by microstrip or co-planar waveguide conductors formed on dielectric surfaces. In addition, the antenna element 12 or 28 can be mounted on one surface of the FSS 14 and connected to coax cable 16, which is mounted on the opposite surface by means of a feed through hole formed in FSS 14.

FIGS. 4A-7C will now be used to describe several exemplary forms of frequency selective surfaces along with their associated electromagnetic properties to further the understanding of the operating principles of the present invention. It will be understood that these different types of FSSs are interchangeably with the FSS 14 described in the embodiments illustrated in FIGS. 1-3, and will also be designated by numeral 14. Those skilled in the art will also understand that in addition to the FSSs described below, numerous other types of FSS having different forms of patterned layers of conducting material are well known, and can easily be applied to antenna structures of the present invention.

The different types of FSS described below were fabricated using a dielectric layer 24 formed of an acrylic plastic material having a thickness $D_2$ of approximately 6.35 mm, and a relative dielectric constant of approximately 3.0 at the frequencies of interest. Of course, as indicated previously, dielectric layer 24 could be formed of any type of low loss substrate such epoxy-glass laminates or other materials such as those used for printed circuit board fabrication.

Figure 4A:
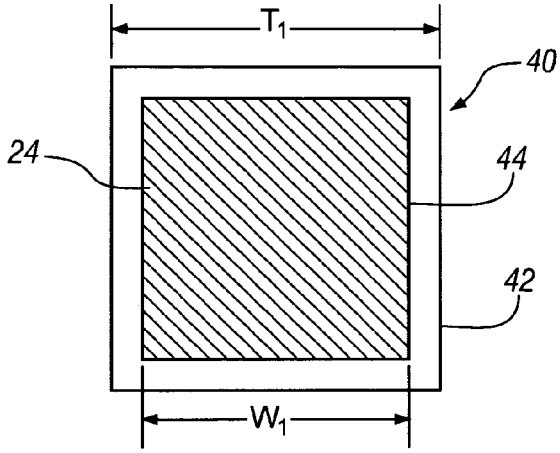
FIGS. 4A-4C show respectively, a unit cell structure for a FSS with a layer of conducting material having square apertures, an equivalent circuit representing the sheet reactance for the unit cell, and electromagnetic properties of the associated FSS.

FIG. 4A illustrates a square unit cell, generally designated 40, used in forming an inductive type FSS 14, such as the one illustrated previously in FIGS. 1-3. Unit cell 40 comprises a square shaped layer of conducting material 42 having a square aperture 44 of width $W_1$, and a cell width defined as its period $T_1$. As described previously, the patterned layer of conducting material 20 for this inductive type FSS 14 is obtained by replicating the unit cell 40 over surface of the patterned layer of conducting material 20 and dielectric layer 24 to create a uniformly spaced array of square apertures, where each aperture is spaced from each neighboring aperture by a distance defined by the cell period $T_1$ and aperture width $W_1$.

Figure 4B:
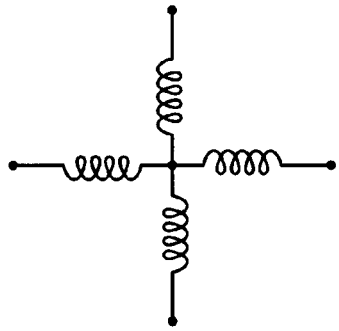

FIG. 4B shows an equivalent circuit representing the sheet reactance for the structure of unit cell 40. The sheet reactance for the FSS 14 having an array of apertures represented by unit cell 40 is inductive as illustrated by the inductors in the equivalent circuit for unit cell 40. This FSS configuration is generally referred to as an inductive type FSS 14.

The use of equivalent circuits, with lumped inductors and capacitors, can be used to describe electromagnetic properties of FSSs at frequencies where the associated wavelength is significantly greater than the dimension of the surface features of the patterned layer of conducting layer material 20 forming the FSS 14. For the types of FSSs being considered here, the period of their unit cells should not be much greater than about one-tenth of a wavelength for the lumped element equivalent circuits to be applicable.

Figure 4C:
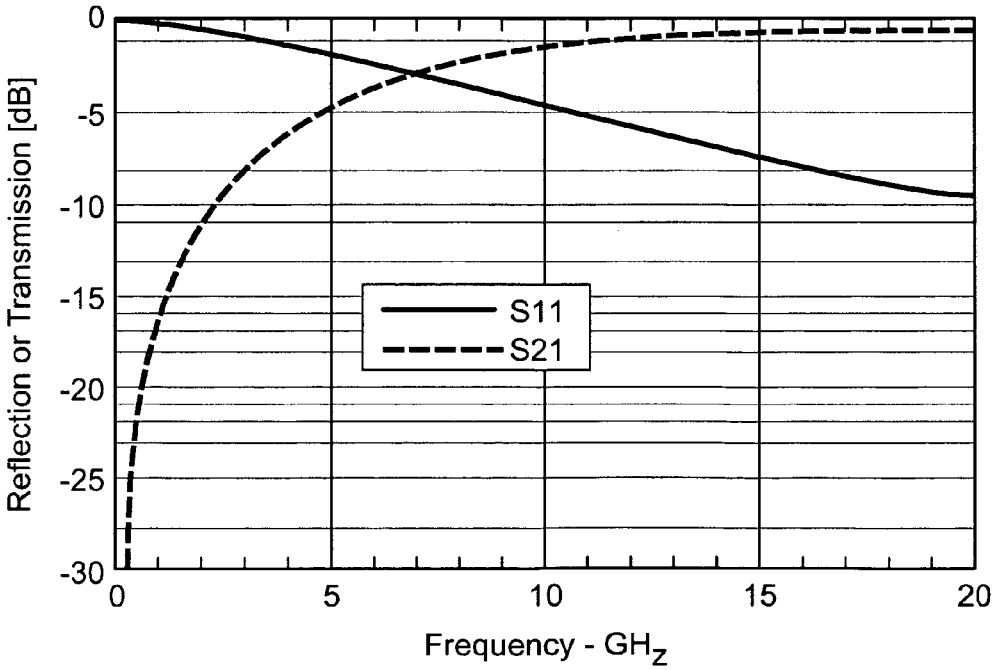

FIG. 4C shows electromagnetic properties of a FSS 14 patterned according to unit cell 40, with $W_1$=5.0 mm, and $T_1$=6.35 mm. The electromagnetic properties are shown as a graph of the surface reflection coefficient S11 and surface transmission coefficient S21 for a normally incident electromagnetic plane wave as a function of frequency.

The graph illustrates that this particular configuration of FSS, which has an inductive sheet reactance, functions as a high pass spatial filter, which reflects electromagnetic energy up to a frequency of about 7.0 GHz (the 3 dB point), and then allows electromagnetic energy of higher frequency to pass through the FSS.

Figure 5A:
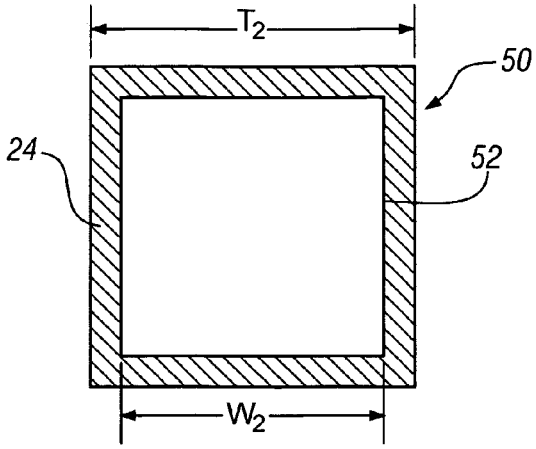
FIGS. 5A-5C show respectively, a unit cell structure for a FSS with a layer of conducting material having conductive elements formed of square plates, an equivalent circuit representing the sheet reactance for the unit cell, and electromagnetic properties of the associated FSS.

FIG. 5A illustrates a square unit cell, generally designated 50, used in forming a capacitive type FSS 14. The cell width of unit cell 50 is defined by its period $T_2$, and it contains square shaped conductive element 52 having a width denoted by $W_2$. The patterned layer of conducting material 20 for this capacitive type FSS 14 is obtained by replicating the unit cell 50 over surface to create a uniformly spaced array of square shaped conductive elements 52, where each such element is spaced from each neighboring element by a distance defined by the cell period $T_2$ and the width $W_2$.

Figure 5B:
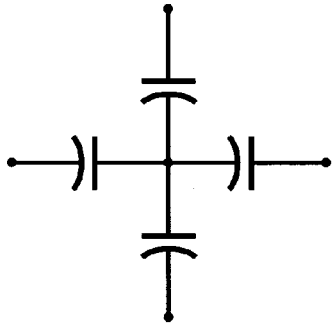

FIG. 5B shows an equivalent circuit representing the sheet reactance for the structure of unit cell 50. The sheet reactance for this type of FSS 14 is capacitive as illustrated by the lumped capacitors of the equivalent circuit for unit cell 50. As a result, this FSS configuration is generally referred to as a capacitive type FSS 14.

Figure 5C:
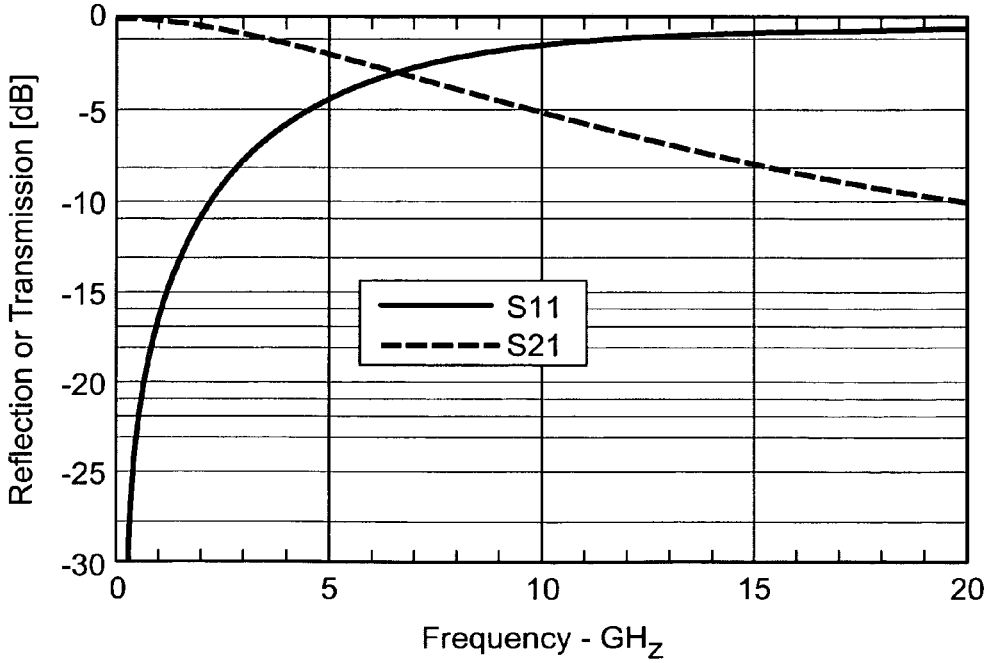

FIG. 5C shows electromagnetic properties of a FSS 14 patterned according to unit cell 50, with $W_2$=5.0 mm, and $T_2$=6.35 mm, as a graph of the surface reflection coefficient S11 and surface transmission coefficient S21 as a function of frequency.

The graph illustrates that this particular configuration of FSS 14, which has a capacitive sheet reactance, functions as a low pass spatial filter, which allows electromagnetic energy up to a frequency of about 7.0 GHz (the 3 dB point) to be transmitted through the FSS 14, and then reflects electromagnetic energy at higher frequencies.

Figure 6A:
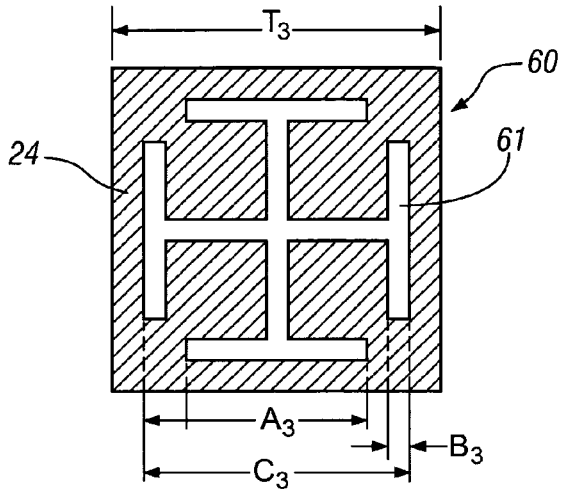
FIGS. 6A-6C show respectively, a unit cell structure for a FSS with a layer of conducting material having conductive elements formed of Jerusalem Crosses, an equivalent circuit representing the sheet reactance for the unit cell, and electromagnetic properties of the associated FSS.

FIG. 6A illustrates a square unit cell, generally designated 60, used in forming a series resonant type FSS 14. Unit cell 60 has a cell width designated by its period $T_3$, and includes a cross shaped conductive element 61, know in the art as a Jerusalem Cross. Again, the patterned layer of conductive material 20 for this series resonant type FSS 14 is obtained by replicating the unit cell 60 over surface to create a uniformly spaced array of conducting Jerusalem Cross elements 61, each being spaced from its neighboring elements by a distance defined by the unit cell period $T_3$ and the dimensions of the Jerusalem Cross element 61.

Figure 6B:
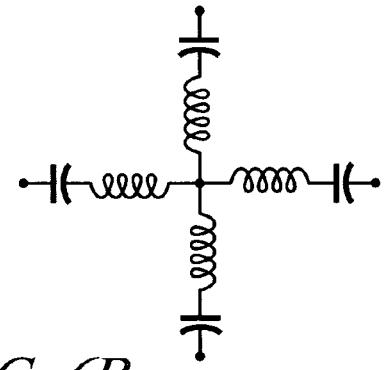

FIG. 6B shows an equivalent circuit representing the sheet reactance for the structure of unit cell 60. The sheet reactance is reactive, varying from capacitive at lower frequencies, to inductive at higher frequencies, as represented by the series connected inductors and capacitors in the equivalent circuit of FIG. 6B. As a result, this FSS configuration is commonly referred to as a series resonant type FSS 14.

Figure 6C:
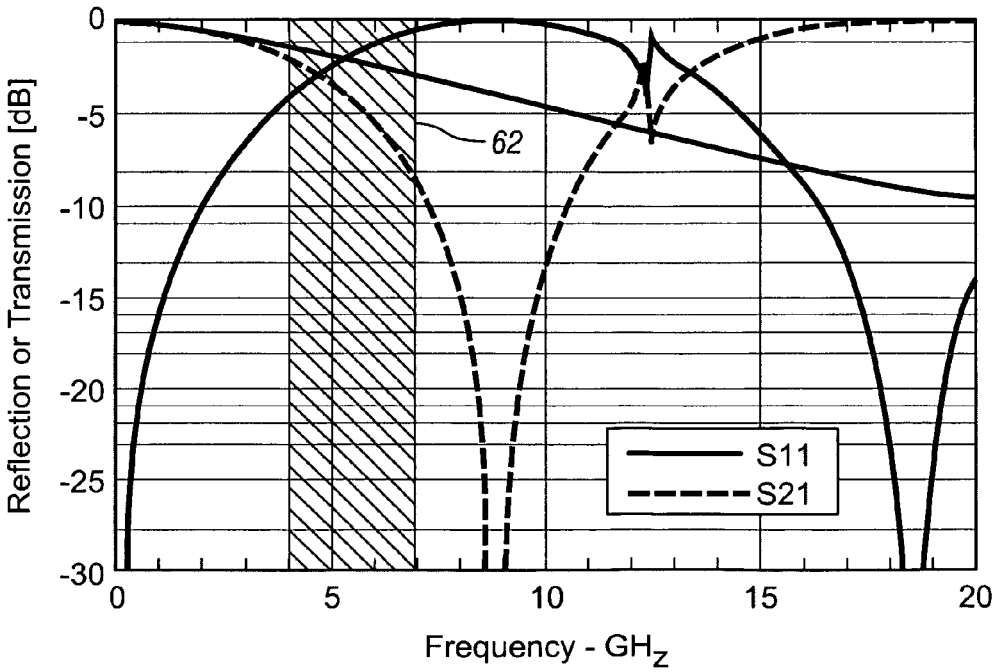

FIG. 6C shows electromagnetic properties a FSS patterned according to a unit cell 60 having a cell period of $T_3$=6.35 mm, and the Jerusalem Cross conducting element 61 having dimensions of $A_3$=4.0 mm, $B_3$=0.5 mm, and $C_3$=5.0 mm. The electromagnetic properties are shown as a graph of the surface reflection coefficient S11 and surface transmission coefficient S21 as a function of frequency.

The graph illustrates that this particular configuration of series resonant FSS 14 has a resonant frequency occurring at approximately 8.8 GHz. This form of FSS functions as a band rejection spatial filter, which passes electromagnetic energy up to a frequency of about 4.5 GHz (3 dB point), then reflects electromagnetic energy in a frequency band near resonance, and again passes higher frequency electromagnetic energy at frequencies above about 13.5 GHz (3 dB point). The reactance of the sheet reactance for this series resonant FSS 14 will be near zero at its resonant frequency due to the interaction of the series inductive and capacitive reactance.

Figure 7A:
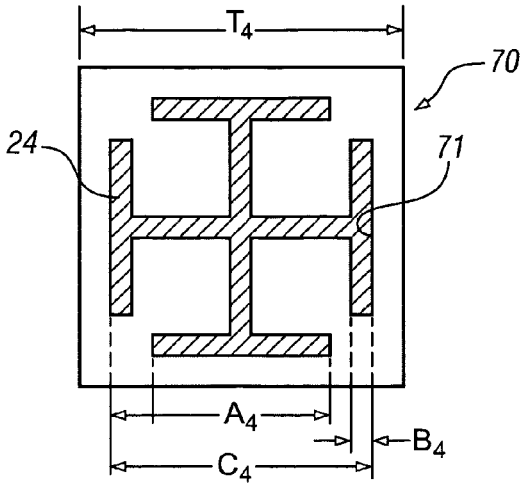
FIGS. 7A-7C show respectively, a unit cell structure for a FSS with a layer of conducting material having apertures in the form of Jerusalem Crosses, an equivalent circuit representing the sheet reactance for the unit cell, and electromagnetic properties of the associated FSS.

FIG. 7A illustrates a square unit cell, generally designated 70, used in forming a parallel resonant type FSS 14. Unit cell 70 has a cell width designated by its period $T_4$, and includes aperture 71 having the same form as form as the Jerusalem Cross conductive element 61 of FIG. 6A. Again, the patterned layer of conductive material 20 for this parallel resonant type FSS 14 is obtained by replicating the unit cell 70 over surface to create a uniformly spaced array of inverse Jerusalem Cross apertures 71, each being spaced from its neighboring apertures by a distance defined by the unit cell period $T_4$ and the dimensions of the inverse Jerusalem Cross aperture 71.

Figure 7B:
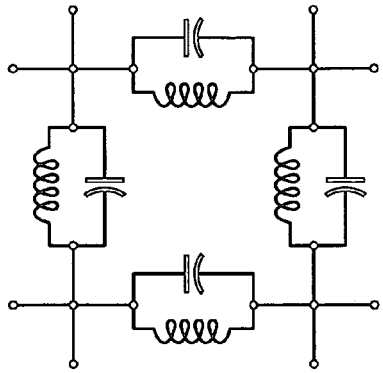

FIG. 7B shows an equivalent circuit representing the sheet reactance for the structure of unit cell 70. The sheet reactance has a reactance varying from inductive at lower frequencies, to capacitive at higher frequencies, as represented by the parallel connected inductors and capacitors of the equivalent circuit of FIG. 7B. As a result, this FSS configuration is commonly referred to as a parallel resonant type FSS 14.

Figure 7C:
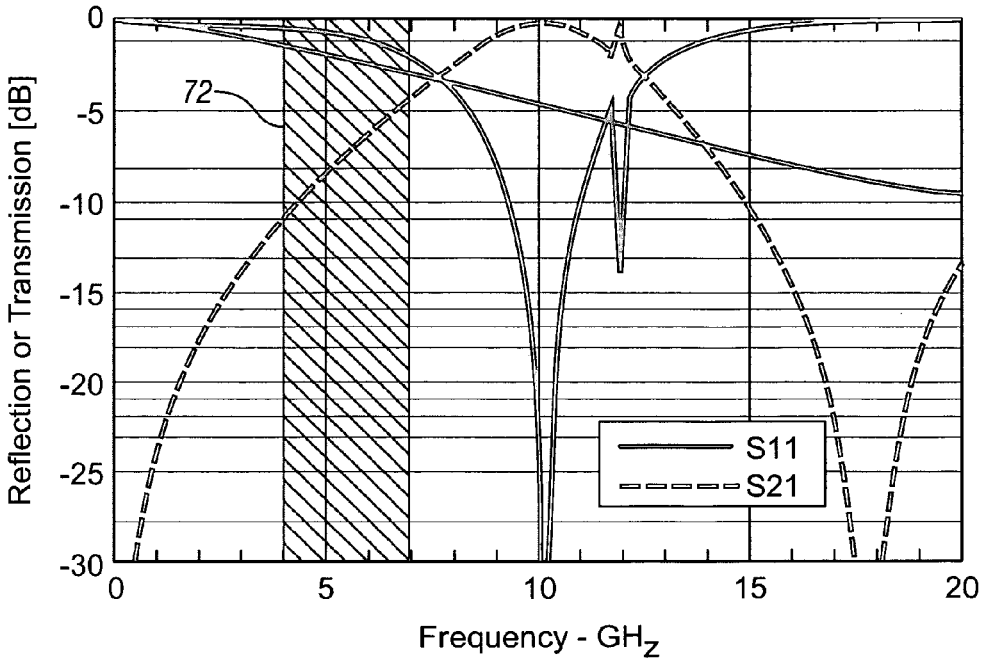

FIG. 7C shows electromagnetic properties of a FSS 14 patterned according to a unit cell 70 having a cell period of $T_4$=6.35 mm, and the inverse Jerusalem Cross aperture 71 having dimensions of $A_4$=4.0 mm, $B_4$=0.5 mm, and $C_4$=5.0 mm. The electromagnetic properties are shown as a graph of the surface reflection coefficient S11 and surface transmission coefficient S21 as a function of frequency.

The graph illustrates that this particular configuration of parallel resonant FSS 14 has a resonant frequency occurring at approximately 10.1 GHz. This form of FSS 14 functions as a band pass spatial filter, which reflects electromagnetic energy up to a frequency of about 7.5 GHz (3 dB point), then transmits electromagnetic energy through the FSS 14 in a frequency band near resonance, and again reflects higher frequency electromagnetic energy having a frequency above about 12.5 GHz (3 dB point). The reactance of the sheet reactance of this parallel resonant FSS becomes quite large at its resonant frequency, due to the interaction of the parallel inductive and capacitive reactance.

The applicants performed a series of experiments to characterize the electromagnetic properties of the above described types of FSS with regard to their ability to support surface wave transmission. Small probes formed from coaxial cables were used to measure the ability of the surfaces to support TE and TM surface waves. The probes were placed parallel to the surface of each of the above types of FSS at a distance of approximately 5.0 mm from the surface and 250 mm from each other. TE surface wave behavior was measured by orientating the probes parallel to each other in a broadside configuration, while TM surface wave behavior was measured by orientating the probes coaxially to each other, with their exposed center conductors in an end-to-end configuration. One probe was used to transmit electromagnetic energy at measurement frequencies ranging from about 3.0 GHz to 15.0 GHz, while the other probe was used to sense the energy in any resulting surface waves propagating along the surface. Reference measurements were taken with the probes located near a solid sheet of conducting copper metal for TM surface wave propagation, and with the probes orientated in a broadside configuration in free space for TE wave propagation. Measurements taken on the solid conducting sheet could not be used as a reference for TE waves since the electric field of TE surface waves is essentially shorted out due to its being oriented parallel to the conductive surface.

The inductive type FSS 14 formed by replicating the square unit cell 40 of FIG. 4A was found not to significantly enhance the propagation of TE surface waves above the references measurements, and provided no significant increase in measured TM surface wave propagation over the measurement frequency range as compared to the reference measurements. It is generally known that FSSs having inductive sheet reactance are capable of supporting TM, but not TE, surface wave propagation. In this case the coupling between the measurement probes, and the inductive type FSS 14 was apparently insufficient to excite enhanced TM wave propagation along its surface.

The capacitive type FSS 14 formed by replicating the square unit cell 50 of FIG. 5A enhanced TE surface wave propagation, averaging about 10 dB above the reference measurements over the measurement frequency range. No significant increase in TM surface wave propagation was found for the capacitive type FSS. It is generally known that FSSs having capacitive sheet reactance are capable of supporting TE, but not TM, surface wave propagation. In this case the coupling between the measurement probes, and the capacitive FSS 14 was apparently significant to provide some enhancement of TE surface wave propagation along its surface.

For the series resonant type FSS 14 formed by replicating square unit cell 60 of FIG. 6A, significantly enhanced TE surface wave propagation, averaging about 15 dB above reference measurements, was found to exist in a narrow band of frequencies from about 4.0 GHz to about 7.0 GHz, below the resonant frequency of the FSS 14. This narrow band of frequencies where TE surface wave propagation is significantly enhanced is depicted in the graph of FIG. 6C by shaded region 62. Above 7.0 GHz, TE surface wave propagation was sharply suppressed or cutoff with increasing frequency. No significant increase in TM surface wave propagation was measured for the series resonant type FSS 14.

For the parallel resonant type FSS 14 formed by replicating unit cell 70 of FIG. 7A, significantly enhanced TM surface wave propagation averaging about 15 dB above reference measurements was found to exist in a narrow band of frequencies from about 4.0 GHz to about 7.0 GHz, below the resonant frequency of the FSS 14. This narrow band of frequencies where TM surface wave propagation is significantly enhanced is depicted in the graph of FIG. 7C by shaded region 72. Above 7.0 GHz, TM surface wave propagation was sharply suppressed or cutoff with increasing frequency. No significant increase in TE surface wave propagation was measured for the parallel resonant type FSS 14.

Additional measurements were conducted on the series resonant type FSS 14, and parallel resonant type FSS 14, to determine the wave guiding properties of their surfaces. The surfaces of the series resonant FSS 14 and parallel resonant FSS 14 were each gradually bowed to curve their surfaces around a metal conducting barrier, which was placed to block direct transmission between the measurement probes. Measurements taken using the probes demonstrated the same significant enhancement of TE and TM surface wave propagation guided along the curved surfaces of the series resonant type FSS 14 and parallel resonant type FSS 14, respectively, that existed when their surfaces were essentially planar, illustrating the wave guiding properties of these types of FSS.

It will be understood by those skilled in the art that the electromagnetic properties of the above described types of FSS 14 can be shifted with respect to frequency, by adjusting the dimensions of the apertures or conducting elements and the period of their unit cells. For example, the resonant frequency of the FSS formed by replicating square unit cell 60 in FIG. 6A is shown to occur at about 8.8 GHz. If the period $T_3$ of the unit cell 60, and the associated dimensions of its Jerusalem Cross element 61 were scaled up in size by a factor of two, a FSS formed by replicating a square unit cell increased in size by two would then have a resonant frequency scaled down by a factor of approximately two, which would then occur at about 4.4 GHz. As a result, all the electromagnetic properties of such a scaled FSS 14 would also be scaled down proportionally in frequency. This frequency scaling technique can be used when patterning the layer of conducting material 20 of a FSS 14 to shift its electromagnetic properties relative to a desired selected frequency.

The above frequency scaling technique of course neglects the effects of dielectric layer 24, which would have to be doubled in thickness for completely accurate frequency scaling of the FSS structure, but the technique is applicable as a first order approximation and will be used hereinafter for the purposes of explaining the principles of the present invention.

For more accuracy regarding the design of different types of FSS, several texts on the subject are available, for example, "Frequency Selective Surfaces: Theory and Design," authored by B. A. Monk, New York, Wiley, 2000, as well as computer simulation programs such as the PMM code developed by Ohio State University, and the HFSS code available from Ansoft Corporation. Using these design tools, the dimensions of the patterned conducting layer of a FSS can be more accurately designed to have desired electromagnetic properties at particular frequency of interest in fabricating antenna structures of the present invention.

Figure 8:
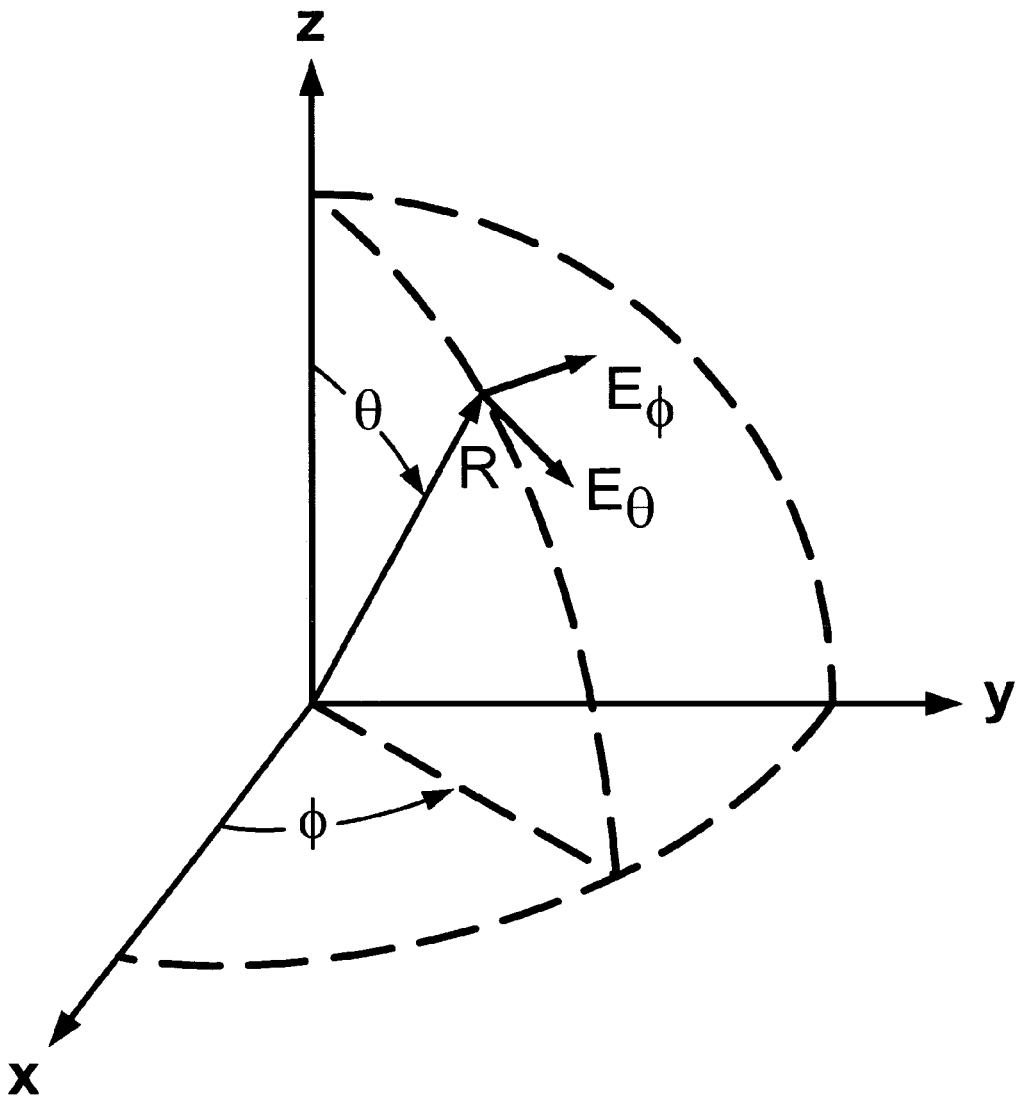
FIG. 8 illustrates a spherical coordinate systems and angles used in defining the far field radiation patterns for antenna structures of the present invention.

Turning now to FIG. 8, there is shown a spherical coordinate systems having angles $\theta$ and $\phi$ that are commonly used in conjunction with the rectangular coordinate system of FIG. 1 to define the far field radiations patterns for antenna structures such as those of the present invention. Such radiation patterns define the gain of an antenna structure located at the origin, where the gain is proportional to the square of the magnitudes of the differently polarized radiated electric field components $E_\theta$ and $E_\phi$ in the different angularly defined directions R away from the origin of the coordinate system.

The three dimensional spherical radiation pattern defined by $E_\phi$ is commonly referred to as the TE radiation pattern due to the fact that its electric field $E_\phi$ is always polarized in a direction transverse (i.e., parallel) to the x-y plane for all values of the angles $\theta$ and $\phi$. Likewise, the three dimensional spherical radiation pattern defined by $E_\theta$ is commonly referred to as the TM radiation pattern because the magnetic field associated with $E_\theta$ component is always in a direction transverse to the x-y plane for all values of the angles $\theta$ and $\phi$.

Two particular planar cuts of the TE and TM radiation patterns will be referred to in the discussion that follows. The first is the H-plane pattern, which is associated with the TE radiation pattern, and the second is the E-plane pattern, which is associated with the TM radiation pattern. These two radiation patters will be used in the discussion that follows.

Considering monopole antenna element 12, which has its longitudinal axis extending along the x-axis of the coordinate system of FIG. 1, the H-plane radiation pattern represents the gain of the TE radiation pattern in the far field, in different angularly defined directions R, as $\theta$ varies from 0° to 360°, with the angle $\phi$=90° (i.e., in the plane defined by $\phi$=90°). The corresponding E-plane radiation pattern represents the gain of the TM radiation pattern in the far field, in different angularly defined direction R, as $\theta$ varies from 0° to 360°, with the angle $\phi$=0° (i.e., in the plane defined by $\phi$=0°).

If monopole antenna element 12 of FIG. 1 is operated in free space (without the presence of FSS 14), it is know to have an omni-directional H-plane radiation pattern, where the magnitude of the electric field component $E_\phi$ remains essentially constant as $\theta$ varies from 0° to 360°. The corresponding E-plane pattern is know to have a figure eight shaped pattern, where the magnitude of the electric field component $E_\theta$ varies as a function of cos $\theta$ with maximum values at $\theta$=0° and 180°, and minimum values or nulls at $\theta$=90° and 270°. These H-plane and E-plane radiation patterns then represent the defined free space radiation characteristic of antenna element 12 when it takes the form of a monopole.

The radiation properties of the different types of FSS, and their ability to modify the defined free space radiation characteristics of antenna element 12 will now be described in terms of the antenna structure 10 shown FIGS. 1 and 2. Four different types of FSS 14 were formed having the shape of square planar sheets, approximately 300 mm on a side. One of the different square unit cells 40, 50, 60, and 70 was replicated to pattern the layer of conducting material 20 for each different type FSS 14. A monopole antenna element 12, with a length L=25 mm, was then positioned parallel to surface of the patterned layer of conducting material 20 of each type of FSS 14 at a height $H_1$ of approximately 5.0 mm, within the antenna element's near field region. For each different type FSS 14, a monopole antenna element 12 was approximately centered with respect to the square sides of each FSS to complete the fabrication of four different types of antenna structure 10. Each of these antenna structures 10 was then separately placed in an anechoic chamber to measure the resulting H-plane and E-plane radiation patterns, while operating the antenna element at a selected frequency.

FIGS. 9A-13B show measured H-plane and E-plane radiation patterns resulting from antenna structures 10 of the present invention having inductive, capacitive, series resonant, and parallel resonant type FSSs 14.

Figure 9A:
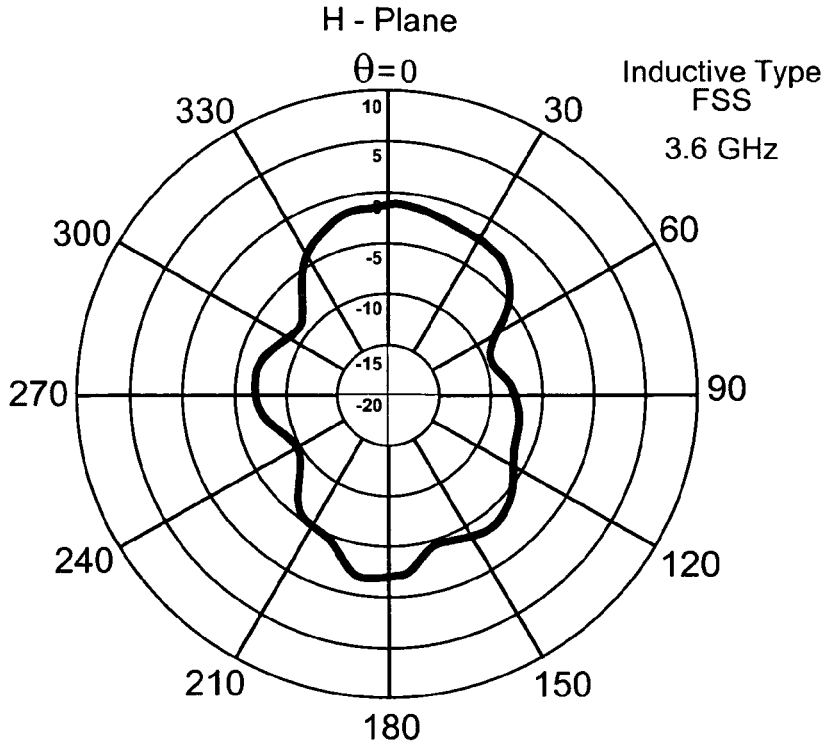
FIGS. 9A and 9B show respectively, the H-plane and E-plane radiation patterns for an antenna structure of the present invention having an inductive type FSS.
Figure 9B:
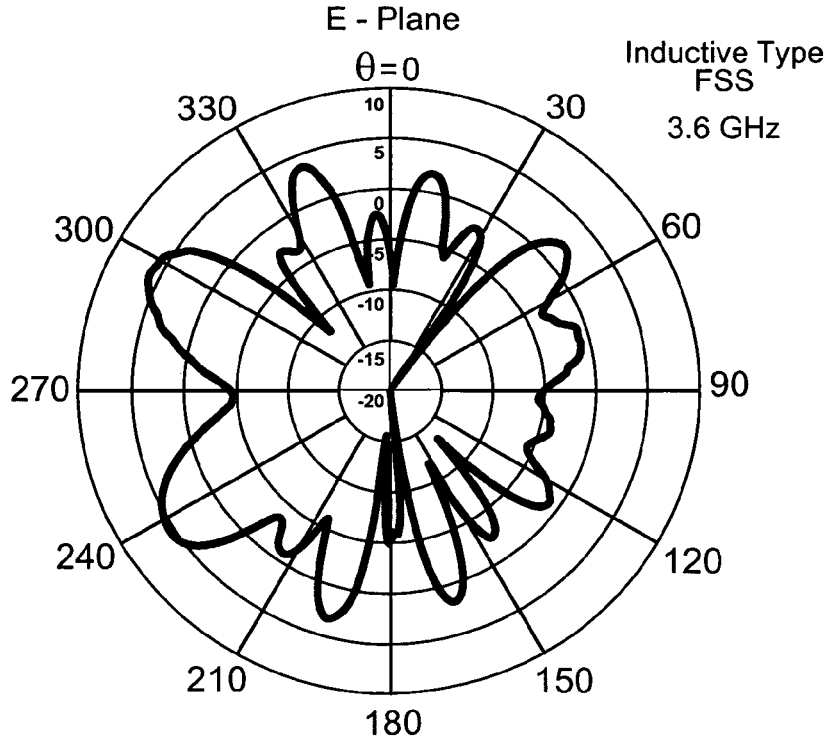

FIGS. 9A and 9B show respectively, the H-plane and E-plane radiation patterns an antenna structure 10 operating at a frequency of 3.6 GHz, for the FSS 14 having the unit cell structure 40 of FIG. 4A. For this inductive type FSS, it will be noted that the H-plane radiation pattern has maximums at θ=0° and 180°, essentially normal to the surface of the FSS. The E-plane radiation pattern is multi-lobed, with the largest lobes not occurring in directions either normal to or parallel (i.e. tangent) with the surface of the FSS.

Figure 10A:
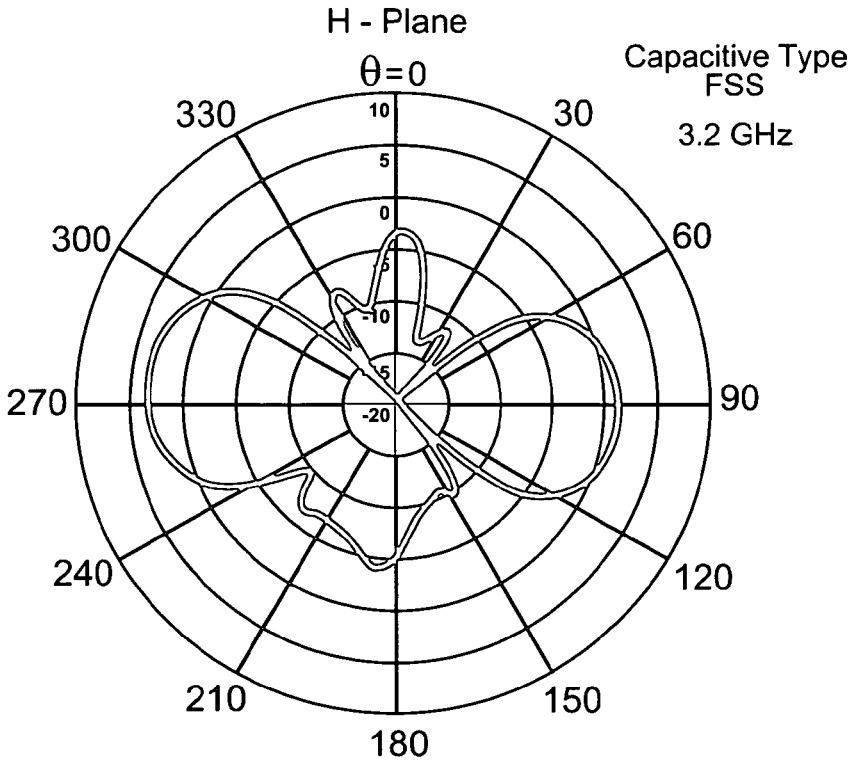
FIGS. 10A and 10B show respectively, the H-plane and E-plane radiation patterns for an antenna structure of the present invention having a capacitive type FSS.
Figure 10B:
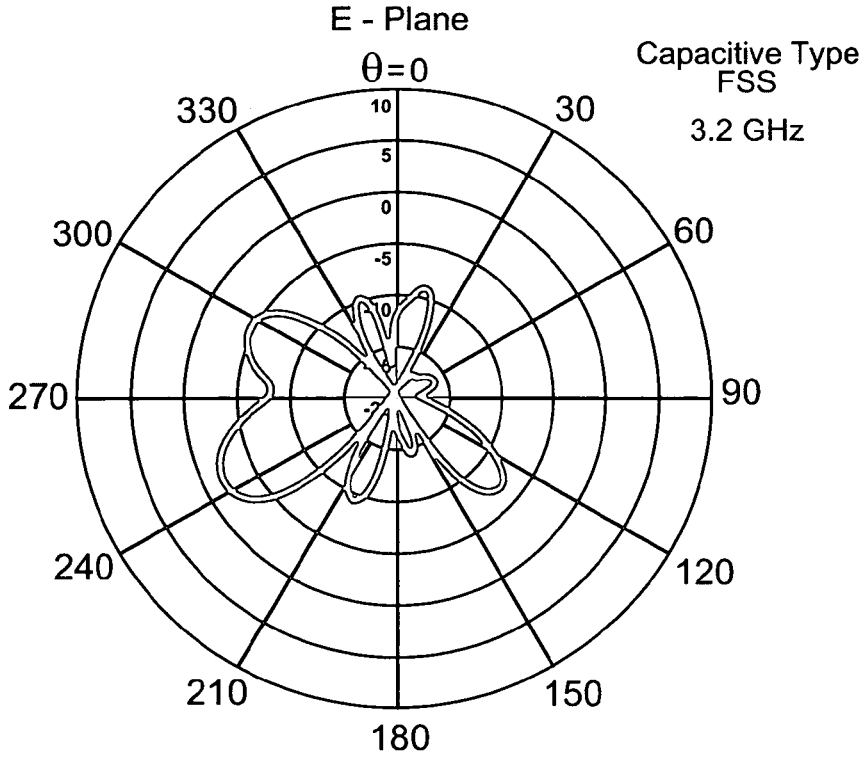

FIGS. 10A and 10B show respectively, the H-plane and E-plane radiation patterns for an antenna structure 10 operating at a frequency of 3.2 GHz, where the FSS 14 has the unit cell structure 50 of FIG. 5A. For this capacitive type FSS 14, it will be noted that the H-plane radiation pattern has essentially rotated 90°, now having maximums at θ=90° and 270°, in directions parallel (i.e., tangent) to the surface of the FSS, and perpendicular to the length or longitudinal axis of antenna element 12. The E-plane radiation pattern appears multi-lobed with reduced gain as compared to the inductive type FSS.

Figure 11A:
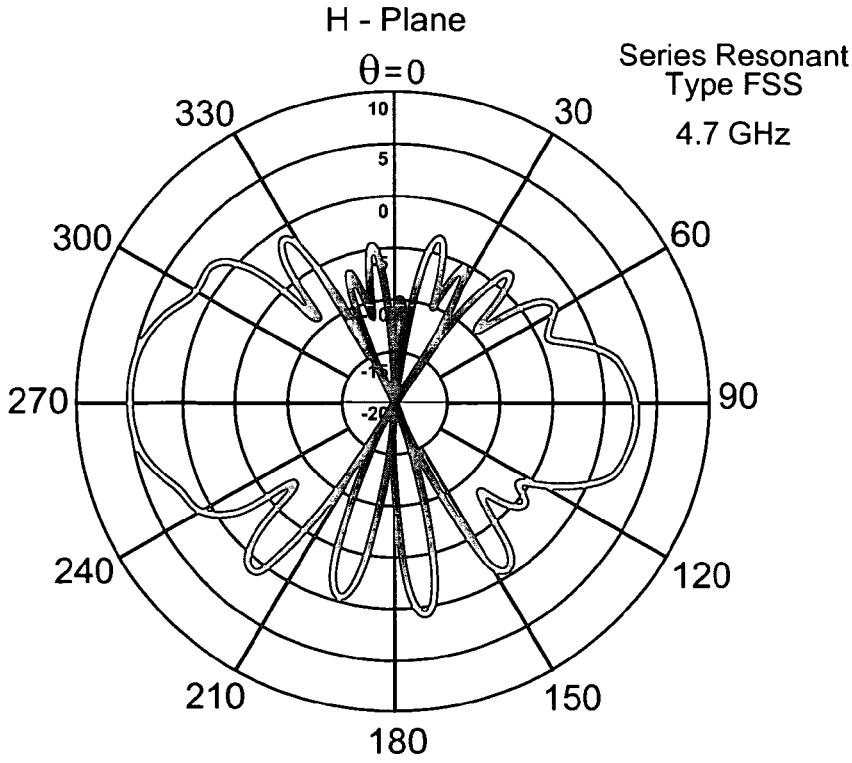
FIGS. 11A and 11B show respectively, the H-plane and E-plane radiation patterns for an antenna structure of the present invention having a series resonant type FSS.
Figure 11B:
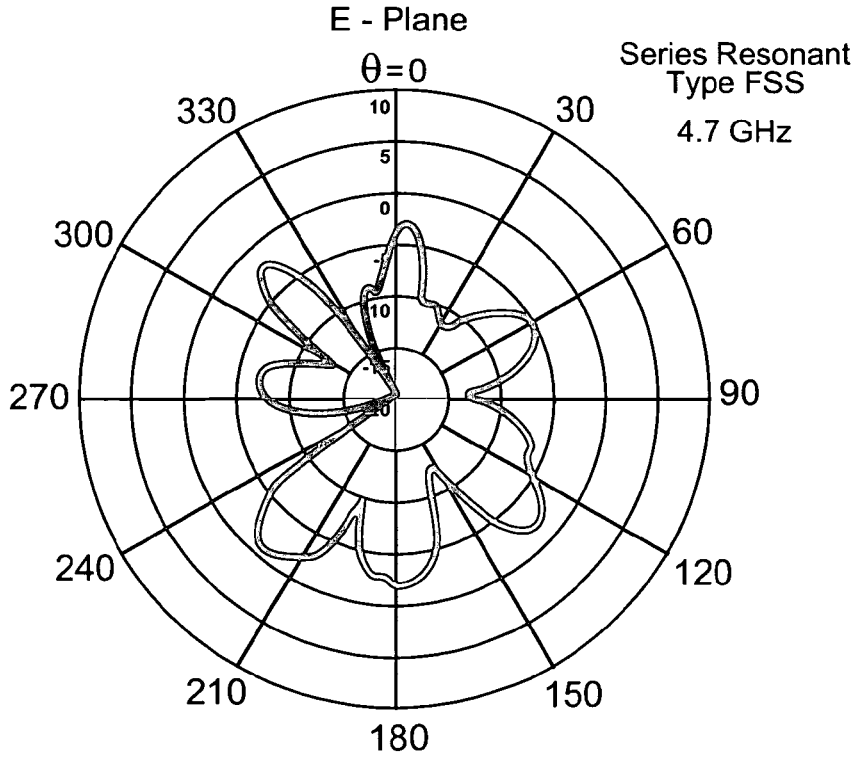

FIGS. 11A and 11B show respectively, the H-plane and E-plane radiation patterns for an antenna structure 10 operating at a frequency of 4.7 GHz, where the FSS 14 is of the series resonant type having the unit cell structure 60 of FIG. 6A.

At this operating frequency, the series resonant FSS 14 has a capacitive sheet reactance, and supports propagation of TE surface waves (see region 62 in FIG. 6C). The TE surface waves propagate in opposite directions, perpendicular to the longitudinal axis of monopole element 12 (parallel to the positive and negative y-axis) along the surface of the series resonant FSS 14. As these TE waves are bound to the surface, they propagate without significant radiation until they reach the edges of FSS 14, where they then radiate in directions essentially parallel (i.e., tangent) to the surface. Accordingly, the H-plane radiation pattern of FIG. 11A has significant maximums in these directions (θ=90° and 270°) parallel (i.e., tangent) to the surface and perpendicular to the longitudinal axis of antenna element 12, which is similar to the behavior of the capacitive type FSS.

The E-plane radiation pattern of FIG. 11B appears multi-lobed with increased gain above that for the capacitive type FSS 14, with increased gain in directions near normal to the surfaces of FSS 14.

Figure 12A:
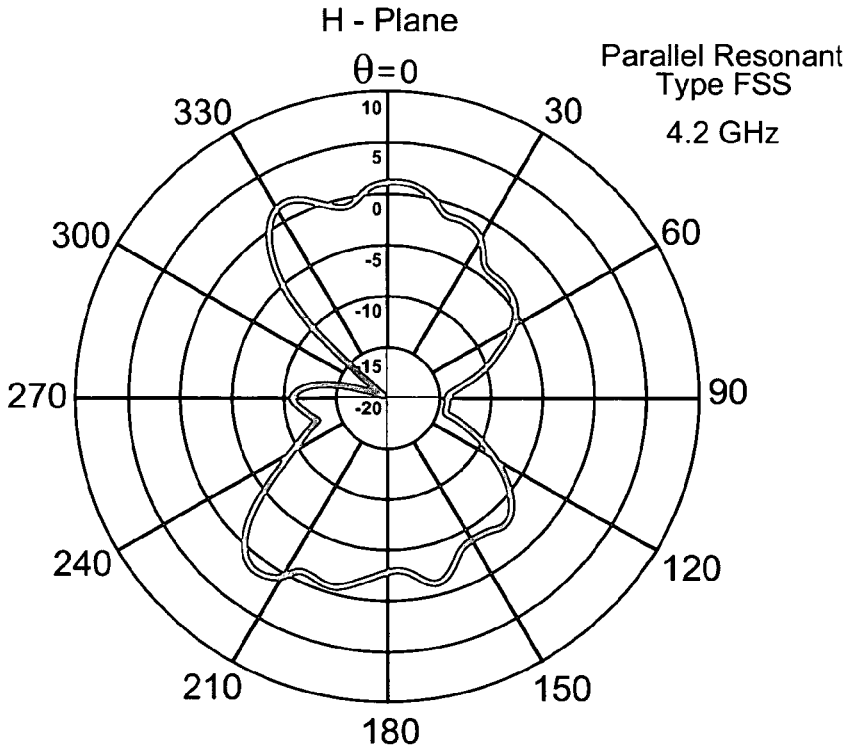
FIGS. 12A and 12B show respectively, the H-plane and E-plane radiation patterns for an antenna structure of the present invention having a parallel resonant type FSS.
Figure 12B:
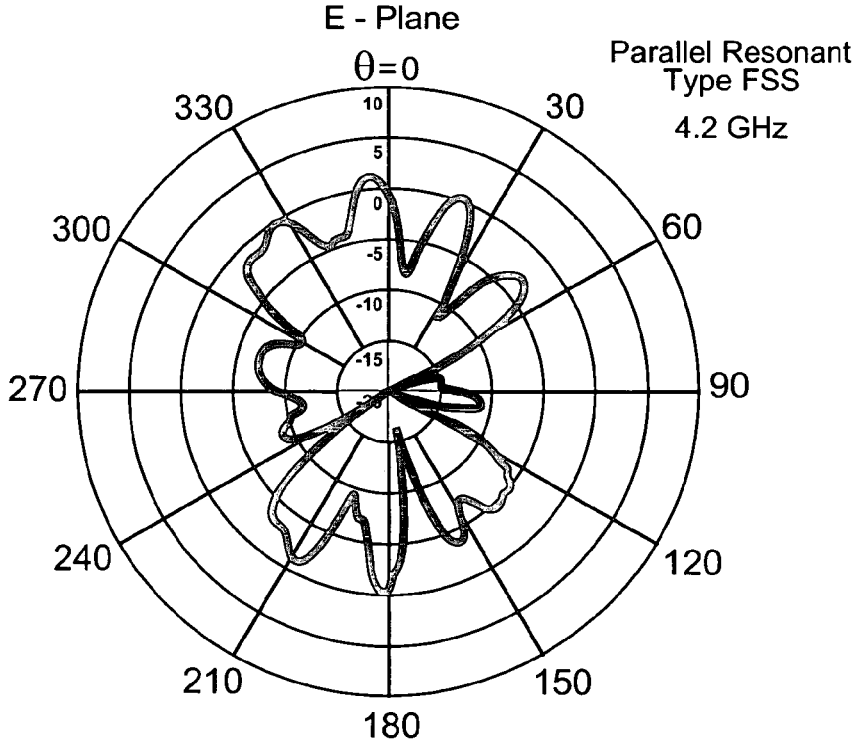

FIGS. 12A and 12B show respectively, the H-plane and E-plane radiation patterns for an antenna structure 10 operating at a frequency of 4.2 GHz, where the FSS 14 is of the parallel resonant type having the unit cell structure 70 of FIG. 7A.

At this operating frequency, the parallel resonant FSS 14, has an inductive sheet reactance, and supports the propagation of TM surface waves (see region 72 in FIG. 7C), that are bound to the surface, without significant radiation until the TM surface waves reach the edges of the FSS, where they then radiate in directions near normal to the surface. The E-plane radiation pattern in FIG. 12B is multi-lobed, with increased gain in directions essentially normal to the surface of the FSS, with maximums near 0° and 180°.

The H-plane radiation pattern in FIG. 12A for the parallel resonant type FSS 14 has significant maximums at θ=0° and 180°, in directions normal to the surface, which is similar to the behavior of the inductive type FSS.

From the above discussion, it will be evident that the radiation characteristics of an antenna element can be modified by the radiation properties of a FSS, by disposing the FSS within the near field of the antenna element 12, and structuring the patterned layer of conducting material forming the FSS to have specific electromagnetic properties at the operating frequency of the antenna element. By selecting the pattering the layer of conducting material to provide the FSS with a surface sheet reactance, which is either capacitive or inductive, the radiation patterns of antenna structures can be directed either near normal to or near parallel (i.e., tangent) to the surfaces of their FSSs.

Those skilled in the art will recognize that the different types of FSSs described above are intended only to be exemplary. Numerous other forms of FFS having different unit cell structures that exhibit capacitive, inductive and resonant sheet reactance behavior are well known, and can easily be utilized in antenna structures in accordance with the principles of the present invention.

Additional embodiments of antenna structures having curved surfaces were fabricated using series and parallel resonant type FSSs to demonstrate the use of the TE and TM wave guiding properties of these particular types of FSSs in fabricating antenna structures in accordance with the principles of the present invention.

Figure 13:
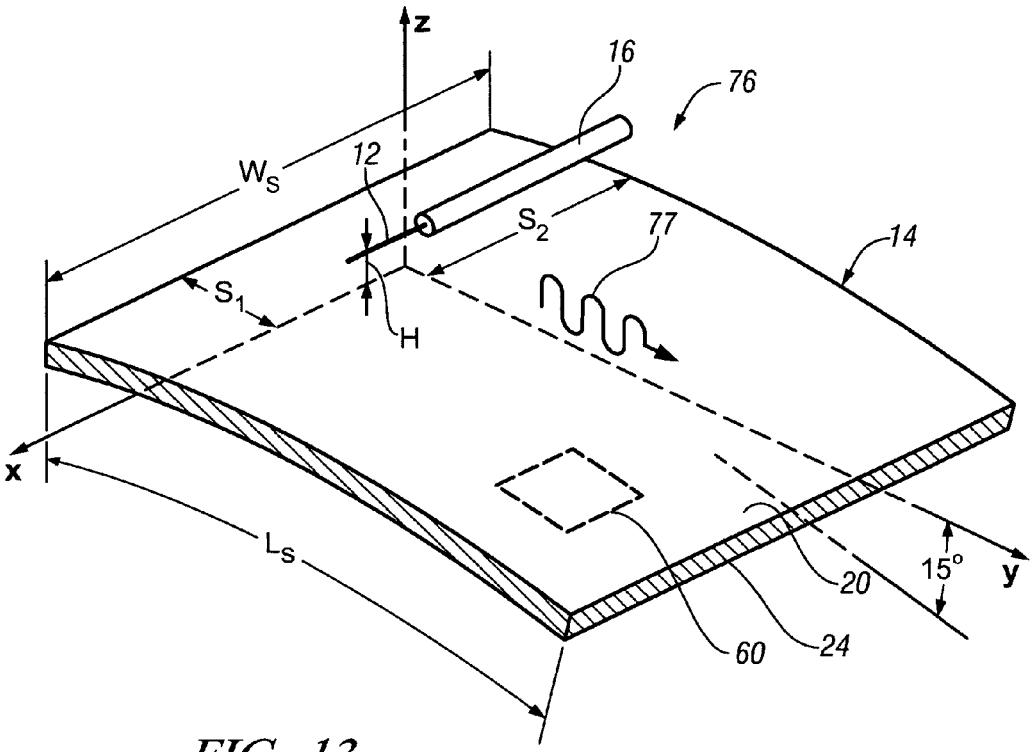
FIG. 13 shows an antenna structure of the present invention having a series resonant type FSS formed as a curved surface.

FIG. 13 shows such an antenna structure generally designated by numeral 76 having a series resonant type FSS 14 formed by replicating unit cell 60 (Jerusalem Cross) to pattern the layer of conducting material 20. The FSS 14 was form in the shape of a rectangular sheet having a length $L_S$=600 mm, and a width $W_S$=300 mm. As shown, the portion of the surface of FSS 14 extending in the direction of the y-axis was gradually curved downward to form an angle of approximately 15° with respect to the x-y plane.

The monopole antenna element 12 was positioned parallel to the surface of the patterned layer of conducting material 20 at a height of approximately H=5.0 mm, and spaced distances of $S_1$=50 mm, and $S_2$=100 mm from the edges of FSS 14 as indicated in FIG. 13. Monopole antenna element 12 excites TE waves, which are shown diagrammatically in FIG. 15 by the waveform designated by 77. The TE waves propagate along the curved surface in a direction perpendicular to the longitudinal axis of antenna element 12. Although not shown in FIG. 13, it will be understood that similar TE waves propagate perpendicular to the longitudinal axis of antenna element 12 in a direction defined by the negative y-axis.

Figure 14A:
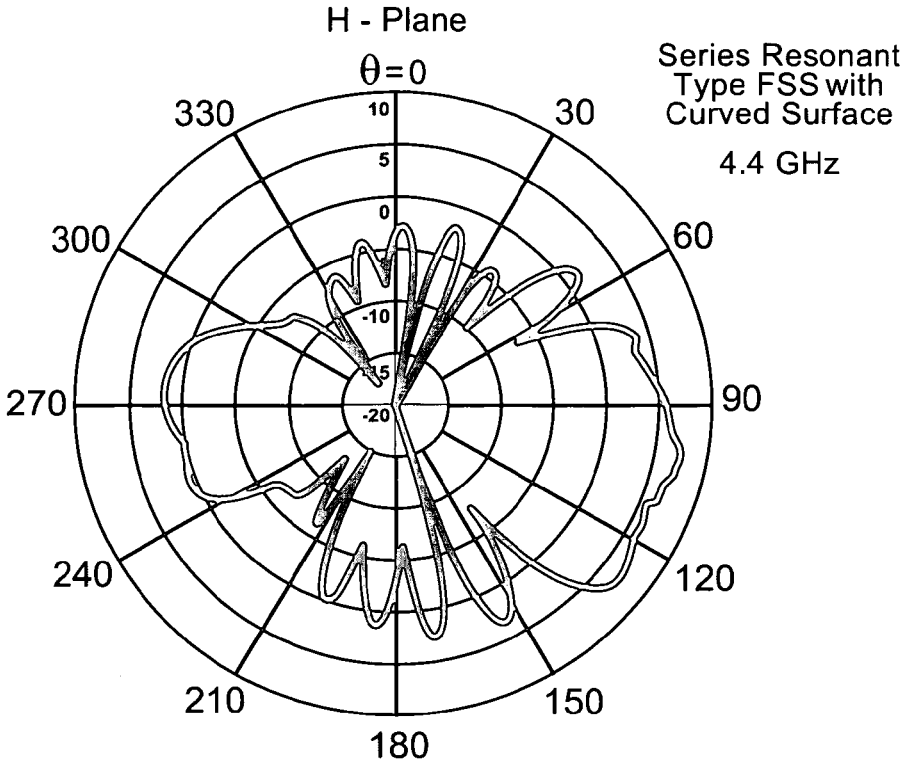
FIGS. 14A and 14B show respectively, the H-plane and E-plane radiation patterns for the antenna structure of FIG. 13.
Figure 14B:
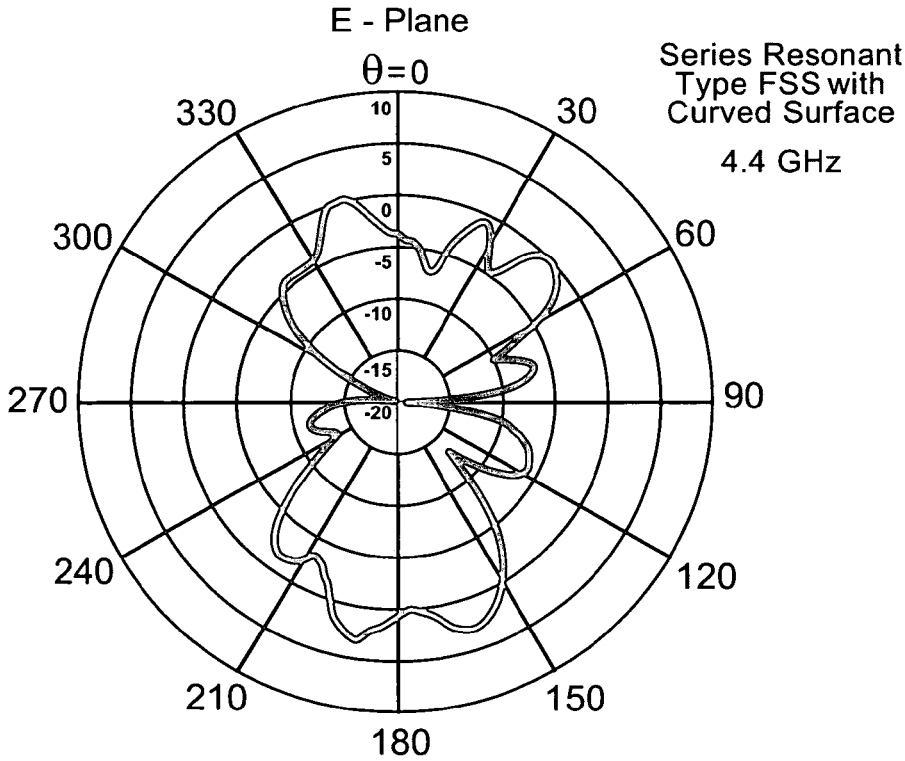

FIGS. 14A and 14B show respectively, the measured H-plane and E-plane radiation patterns for the above antenna structure 76 with its monopole antenna element 12 operating at 4.4 GHz. Referring to FIG. 6C, it will be recognized that at the operating frequency of 4.4 GHz falls within region 62, where the series resonant FSS enhances the propagation of TE surface waves, and has a capacitive sheet reactance. This is evident in the H-plane radiation pattern of FIG. 16A, which shows the center of one of the primary radiation lobes in the direction of the positive y-axis to be at approximately 105°, which coincides with the direction of the downwardly curved portion of FSS 14 forming an angle of 15° with respect to the x-y plane. This is due to the monopole antenna element 12 exciting TE surface waves, which propagate along the curved surface of the FSS 14, and then radiate from its edge in a direction tangent to the surface.

It will also be noted that antenna structure 76 continues to have a significant H-plane radiation lobe or beam at θ=270° even though the extent of the surface of FSS 14 is substantially reduced in that direction due to the monopole element 12 being spaced closer to the edge of the FSS 14, as indicated by the dimension $S_1$. This is due to the capacitive nature of the surface sheet reactance, and the excitation of TE waves propagating along the surface in the direction of the negative y-axis. As shown, the monopole antenna element 12 only excites TE surface waves in directions perpendicular to its longitudinal axis, and parallel to the surface of FSS 14.

FIG. 14B shows the E-plane radiation pattern for the antenna structure 76 of FIG. 13. The series resonant type FSS 14 does not significantly support TM surface wave propagation, and the E-plane pattern has nulls at θ=90° and 270° degrees in directions along the surface defined by the positive and negative x-axis.

Figure 15:
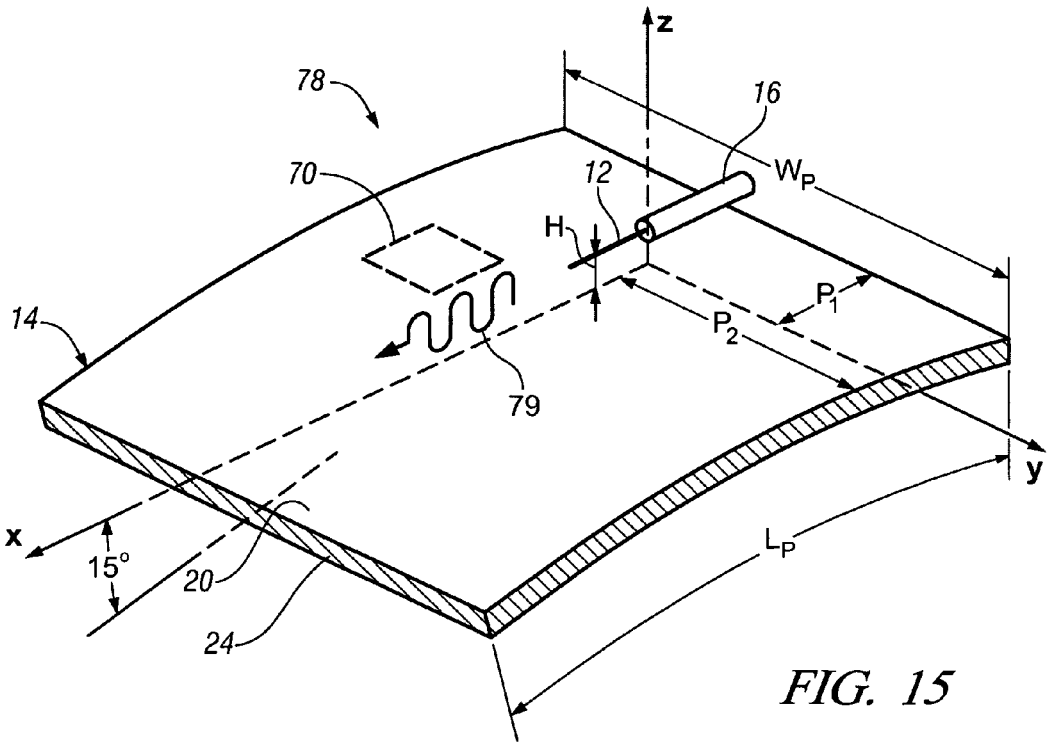
FIG. 15 shows an antenna structure of the present invention have a parallel resonant type FSS formed as a curved surface.

FIG. 15 shows an antenna structure generally designated by numeral 78 having a parallel resonant type FSS 14 formed by replicating unit cell 70 (inverse Jerusalem cross apertures) to pattern its layer of conducting material 20. For this embodiment, FSS 14 was formed in the shape of a rectangle having a length of $L_P$=600 mm, and a width $W_P$=300 mm. As shown, the portion of the surface of FSS 14 extending in the direction of the x-axis was gradually curved downward to form an angle of approximately 15° with respect to the x-y plane.

The monopole antenna element 12 was positioned parallel to the surface of the patterned layer of conducting material 20 at a height of approximately H=5 mm, and spaced distances of $P_1$=100 mm, and $P_2$=150 mm from the edges of FSS 14, as illustrated in FIG. 15. Monopole antenna element 12 excites TM waves, which are shown diagrammatically by the waveform designated by 79. The TM waves propagate along the curved surface in a direction parallel to the longitudinal axis of antenna element 12. Although not shown in FIG. 15, it will be understood that similar TM waves also propagate along the surface parallel to the longitudinal axis of antenna element 12 in a direction defined by the negative x-axis.

Figure 16A:
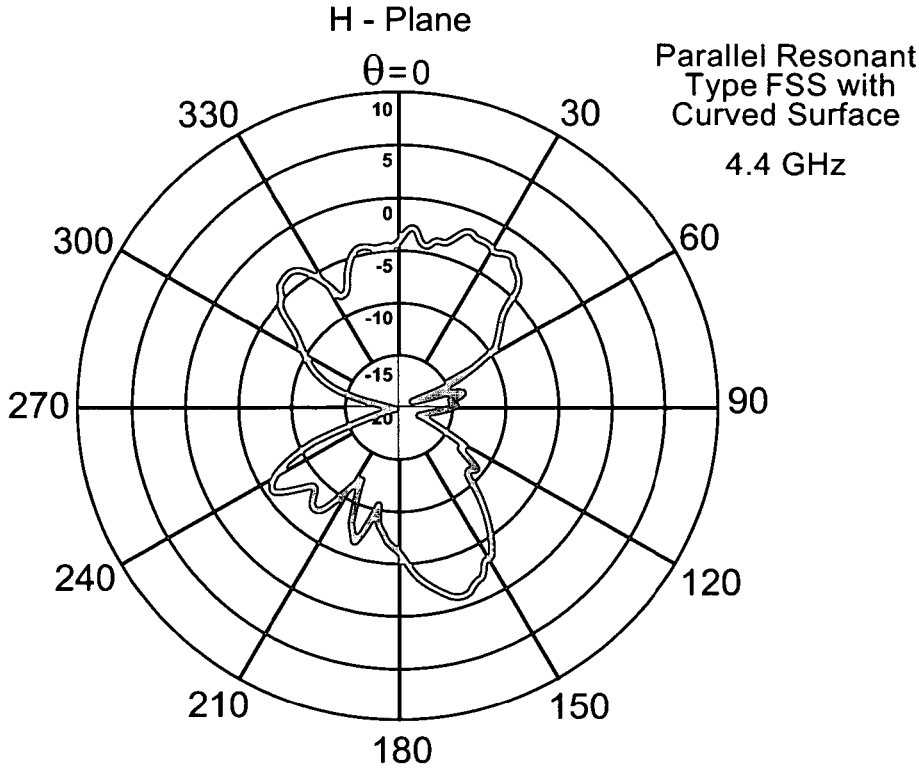
FIGS. 16A and 16B show respectively, the H-plane and E-plane radiation patterns for the antenna structure of FIG. 15.
Figure 16B:
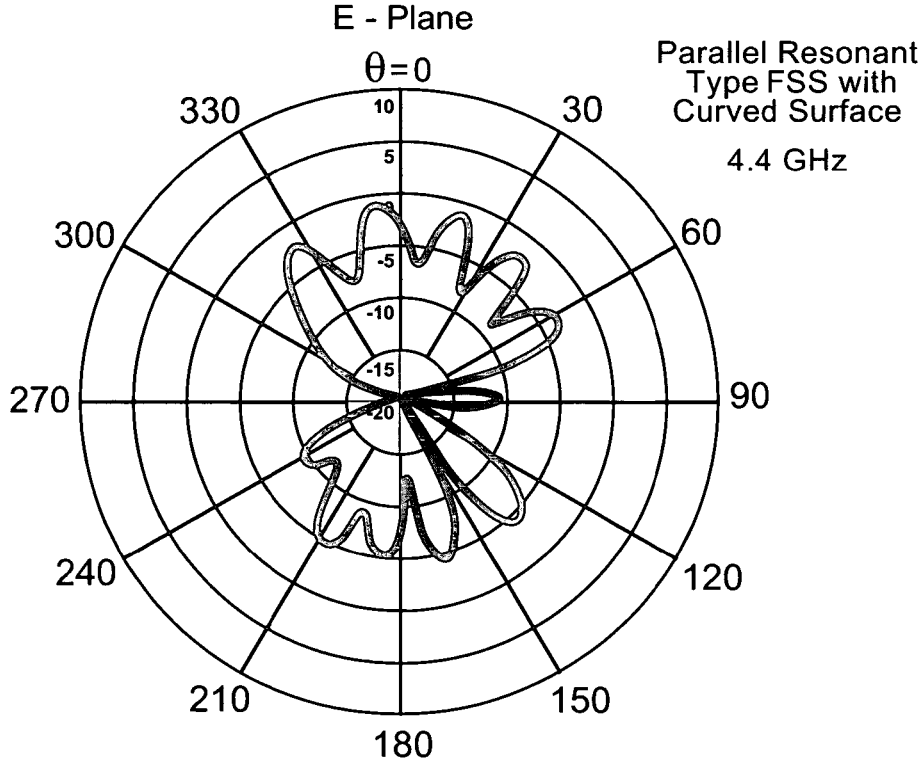

FIGS. 16A and 16B show respectively, the measured H-plane and E-plane radiation patterns for the above antenna structure 78 with its monopole antenna element 12 operating at 4.4 GHz. Referring to FIG. 7C, it will be recognized that at the operating frequency of 4.4 GHz falls within region 72, where the parallel resonant FSS 14 enhances the propagation of TM surface waves, and has an inductive sheet reactance. The presence of the TM surface waves traveling along the curved surface of antenna structure 78 can be seen by comparing the resulting E-plane radiation pattern of FIG. 16B with the E-plane radiation pattern of FIG. 12B where the parallel resonant FSS 14 was not curved. The comparison shows the lobes in the E-plane pattern near 60° and 120° in FIG. 12B, each rotated approximately 15°, to θ=75° and 135°, respectively, in the E-plane pattern of FIG. 16B, due to the 15° surface curvature of the FSS downward from the y-axis.

Although the parallel resonant type FSS 14 supports TM surface waves at this frequency, and some rotation of the E-plane pattern occurs due to the curvature of the surface of the FSS 14, the E-plane radiation pattern shown in FIG. 16B has nulls at θ=105° and 270° along the directions tangent to the surface of the FSS 14 at its edges. This is because the electric field associated with the excited TM waves is essentially parallel to the direction of propagation, and as a result, the propagating TM waves will not radiate into free space at angles near the direction of the surface near the edges of FSS 14.

FIG. 16A shows the H-plane radiation pattern for the antenna structure 78 of FIG. 15. The parallel resonant type FSS does not significantly support TE surface wave propagation, and at the frequency of operation of monopole antenna element 12, the sheet reactance of the parallel resonant type FSS 14 is inductive. As a result, the H-plane radiation pattern has nulls at 90° and 270° degrees, and principal radiation lobes in directions near normal to the surface of the FSS 14, similar to the H-plane pattern for the inductive type FSS 14 discussed previously.

From the above discussion, it will be evident the TE and TM wave guiding properties of series and parallel resonant type FSSs 14 can be used to modify the radiation patterns of antenna structures of the present invention that are formed on curved surfaces. By selecting the patterning of the layer of conducting material 20 to form either a series or parallel resonant FSS 14 to enhance the propagation of either TE or TM surface waves, the respective TE (H-plane) and TM (E-plane) radiation patterns for the antenna structures can be rotated or directed to follow the curvature of the surface in the directions that the TE and TM waves propagate.

The surface reactance of series and parallel resonant type FSSs vary between capacitive and inductive, or vice versa, at frequencies above and below the resonant frequency of the particular FSS. In addition, the series resonant type FSS has been shown to support the propagation TE surface wave at frequencies in region 62 (see FIG. 6C), followed by a sharp cutoff for TE wave propagation at frequencies above region 62. The parallel resonant type FSS has been shown to support the propagation of TM surface waves at frequencies in the region 72 (see FIG. 7C), followed by a sharp cutoff for TM wave propagation at frequencies above region 72. As will now be described with reference to FIGS. 17A and 17B, these electromagnetic properties can be used for adjusting the radiation patterns of antenna structures formed in accordance with the principles of the present invention.

Figure 17A:
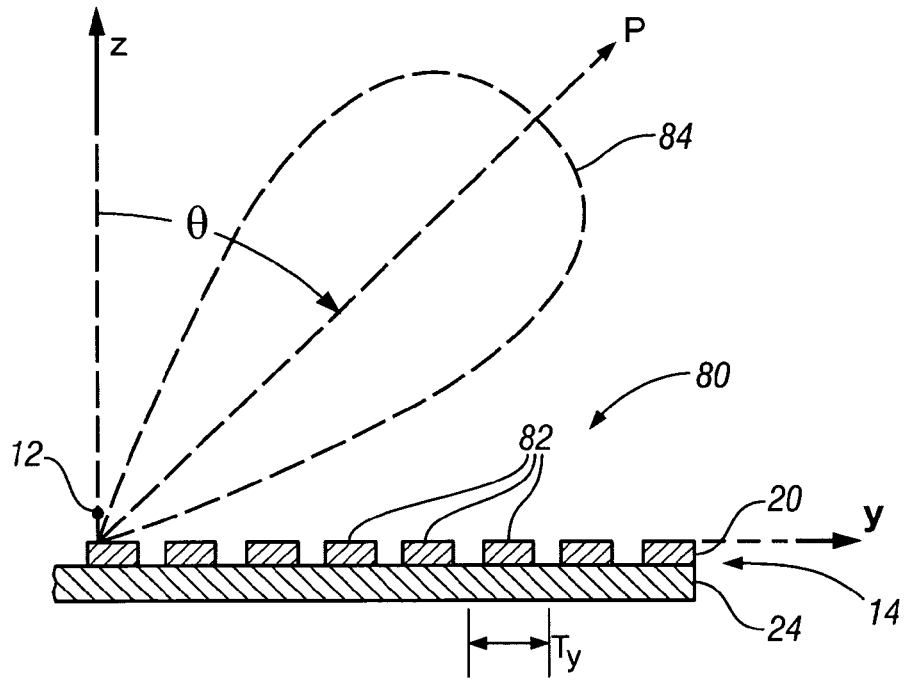
FIGS. 17A and 17B illustrate respectively, the adjustment H-plane and E-plane radiation patterns of antennas structures formed in accordance with the principles of the present invention.

FIG. 17A shows a portion of an antenna structure designated as 80, having a series resonant type FSS 14, and a monopole antenna element 12 shown in cross-section. The layer of conducting material 20 is patterned to have conductive elements 82 disposed on dielectric layer 24. The period of the unit cells is designated as $T_y$, For simplicity of illustration, only a portion of antenna structure 80 is shown in one quadrant of the y-z plane, with the H-plane radiation pattern depicted as a single radiation lobe or beam 84 having a maximum gain in the angularly defined direction P away from the antenna structure 80, defined by the angle θ. The H-plane pattern as shown in FIG. 17A would of course would be symmetrically repeated or mirrored in the other quadrants of the y-z plane that are not shown.

Assume for the moment that the conducting elements 82 are formed by replicating the unit cell 60 (see FIG. 6A) over the surface of the layer of conducting material 20. Conducting elements 82 would then take the form of the Jerusalem Cross conducting elements 61 of FIG. 6A, with the unit cell period $T_y$=$T_3$. The FSS 14 in FIG. 17A would then be of the series resonant type, as previously described in relation to FIGS. 6A-6C.

If monopole antenna element 12 is operating within frequency region 62, the series resonant type FSS 14 would have a capacitive sheet reactance, and TE surface waves would propagate along the surface of FSS 14 to its edge, then radiate into free space in the direction defined by the y-axis. That being the case, the principal lobe or beam 84 of the H-plane radiation pattern illustrated in FIG. 17A would be directed along the y-axis at θ=90°, similar to the H-plane radiation patterns previously shown in FIGS. 10A and 11A.

If the monopole antenna element 12 was operated at a frequency above the resonant frequency of the series resonant FSS 14, where the sheet reactance becomes inductive, and the angularly defined direction P of the principal radiation lobe or beam 84 of the H-plane radiation pattern will be directed more normal to the surface of FSS 14 (in the direction of the z-axis where θ=0°), as indicated in the previous discussion related to FIGS. 9A, and 12A.

As discussed previously, the electromagnetic properties of a FSS and the frequency of resonance can be shifted in frequency by proportionately scaling the dimensions unit cells and the associated conducting elements or apertures forming the layer of conducting material. Accordingly, for a selected operating frequency of monopole antenna element 12, the sheet reactance of the series resonant FSS 14 in FIG. 17A can be varied from capacitive to inductive by proportionately varying the dimensions of the unit cell period $T_y$ and associated Jerusalem Cross conducting elements 82 to shift the resonant frequency of the FSS 14.

For example, if monopole antenna element 12 in FIG. 17A has an operating frequency of 4.7 GHz, and $T_y=T_3=6.35$ mm, the unit cells of FSS 14 in FIG. 17A will have the same dimensions of the unit cell 60 of FIG. 6A. In this case, the surface sheet reactance of FSS 14 of FIG. 17A will be capacitive, enhanced TE wave propagation will occur, and the angularly defined direction P of the principal lobe or beam 84 of the H-plane radiation pattern will be directed essentially parallel (i.e., tangent) to the surface of FSS 14 (near angles of θ=90°).

If the unit cell period $T_y$ and the associated dimensions of the conducting elements 82 are scaled up in size by a factor of say three from those of unit cell 60 in FIG. 6A, the resonant frequency of the FSS 14 of FIG. 17A would then be approximately reduced by a factor of three, from about 8.8 GHz (see FIG. 6C) to around 2.9 GHz. In this case, the surface sheet reactance of FSS 14 of FIG. 17A would appear inductive, TE wave propagation would be cutoff, and the angularly defined direction P of the principal lobe or beam 84 of the H-plane radiation pattern would be near normal to the surface of FSS 14 (at angles near θ=0°).

Thus, by varying the dimension of the period $T_y$ of the unit cells of the series resonant FSS 14 of FIG. 17A so that its sheet reactance, as defined by its resonant frequency, varies between capacitive and inductive at the operating frequency of antenna element 12, the angularly defined direction of the principal lobe or beam 84 of the H-plane radiation pattern can be varied between directions essentially parallel to and normal to the surface of FSS 14. Thus, the gain of the H-plane radiation pattern can be maximized in a selected or predetermined angularly defined direction, by varying the period and dimensions of the unit cells forming the series resonant FSS 14 to shift its resonant frequency relative to the selected frequency of operation of antenna element 12.

Figure 17B:
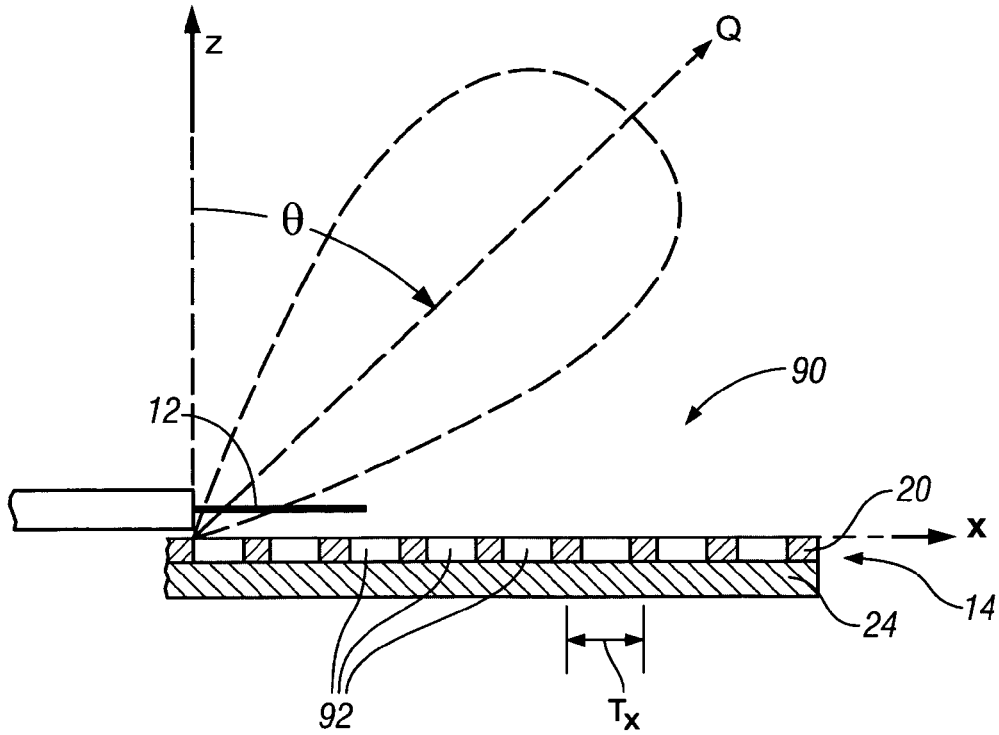

FIG. 17B shows a portion of an antenna structure embodiment designated as 90, having a parallel resonant type FSS 14, and a monopole antenna element 12, with its longitudinal axis extending parallel to the x-axis.

Again, only a portion of antenna structure 90 is shown in one quadrant of the x-z plane. The E-plane radiation pattern for antenna structure 90 is depicted as having a single radiation lobe or beam 94 with its maximum gain in the angularly defined direction Q, as defined by the angle θ. It will be understood from the previous measurements that the E-plane pattern would actually have multiple lobes, but to simplify the discussion, only a single radiation lobe or beam 94 is shown in FIG. 17B. The E-plane pattern for antenna structure 90 would also tend to be symmetrically repeated or mirrored in the other quadrants of the x-z plane that are not shown.

For this embodiment, a proportionally scaled version of unit cell 70, with a period of $T_x$, is replicated over the surface of the layer of conducting material 20 to form inverse Jerusalem Cross apertures 92 to fashion the parallel resonant type FSS 14 of FIG. 17B.

As with the prior embodiment of FIG. 17A, proportionately varying the dimensions of the unit cell period $T_x$, and associated Jerusalem Cross apertures 92, will vary the resonant frequency and the surface sheet reactance of the parallel resonant FSS 14 of FIG. 17B, from inductive to capacitive, depending upon the operating frequency of the monopole antenna element 12. The applicants have found that by varying the unit cell period $T_x$ in this fashion, the gain of the E-plane radiation pattern can be maximized in a particular selected or predetermined angularly defined direction Q, as defined by the angle θ. However, unlike the H-plane pattern for the embodiment of FIG. 17A, adjustment of the E-plane radiation pattern for angles near θ=0° is not viable as TM surface waves will not radiate from the edges of the parallel resonant FSS 14 in directions nearly parallel (i.e., tangent) to its surface.

Accordingly, the above technique of tuning the resonant frequency of a resonant type FSS to have the appropriate surface sheet reactance in relation to the operating frequency of a closely spaced antenna element, provides a convenient method for adjusting the radiation characteristics of the resulting antenna. Accordingly, for series resonant type FSSs, the gain of the TE radiation pattern can be maximized in a selected angularly defined direction away from the associated antenna structure. Likewise, for parallel resonant type FSSs, the gain of the TM radiation pattern can be maximized in selected angularly defined directions away from the associated antenna structure.

As described above, antenna structures formed in accordance with the present invention can be fabricated to be relatively low profile compared to the wavelength of operation, and can be conformed to both planar and non-planar surfaces. These aspects along with ability to adjust radiation patterns of these antenna structures to accommodate their surrounding environment, makes their application particularly attractive for use on automotive vehicles. Embodiments of the present invention adapted for automotive applications will now be described.

Figure 18:
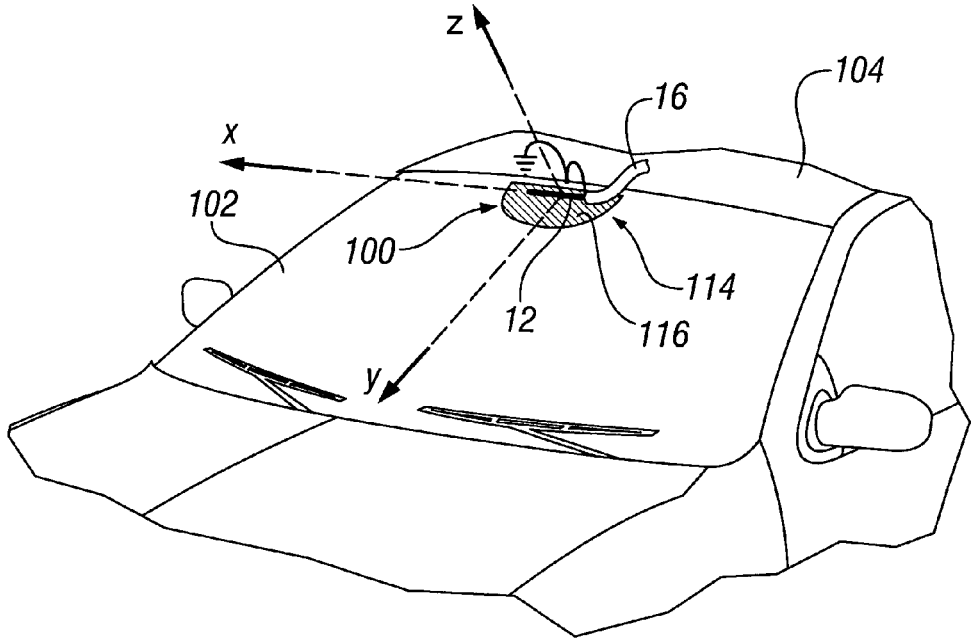
FIG. 18 is a perspective view of an antenna structure of the present invention, which includes a series resonant FSS, and is adapted for use on an automobile windshield.

FIG. 18 illustrates an embodiment of the present invention adapted for use on the windshield of an automotive vehicle. In this application, antenna structure 100 is shown positioned near the center of the upper edge on the glass windshield 102 of an automobile 104. As described previously, monopole antenna element 12 in this embodiment is shown as being formed by the extended center conductor of coaxial cable 16, and is positioned proximate to, and near the upper center edge of FSS 114, with its longitudinal axis directed along the x-axis, parallel to the surface of FSS 114. In this view, FSS 114 is not directly visible, but extends under a thin dielectric layer 116. The outer shield of coaxial cable 16 is shown schematically grounded to the metal surface of the body of automobile 104 near the center upper edge of the windshield 102.

Figure 19:
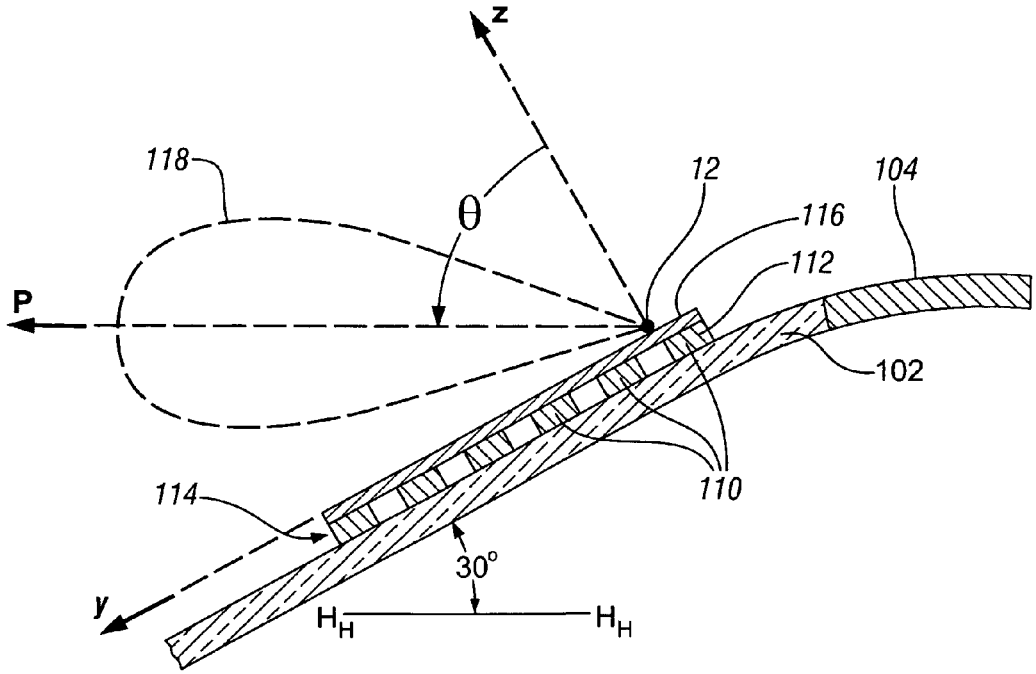
FIG. 19 is a cross-sectional view taken through y-z plane of the antenna structure of FIG. 18.

For this embodiment, FSS 114 is shaped in the form of a semi-circle having a radius of approximately one wavelength at the operating frequency of monopole antenna element 12, and is covered by the thin dielectric layer 116, which is used to space monopole antenna element 12 from the surface of the patterned layer of conducting material 112 of FSS 114 (see FIG. 19). As discussed below, FSS 114 is patterned as a series resonant type FSS.

FIG. 19 shows a cross-sectional view of the antenna structure 100 of FIG. 18 taken through the y-z plane, where the thickness of the various layers are not to scale, and have been expanded for ease in illustration. In this embodiment, the patterned layer of conducting material 112 is formed directly on the outside surface of glass windshield 102, which acts as a dielectric layer to support the conducting elements 110 of the patterned layer of conducting material 112.

Techniques for forming or printing conducting material on the window glass of automobiles are well known. Those skilled in the art will recognize that the patterned layer of conducting material 112 could also be formed on the opposite inside surface of the glass windshield 102 so that antenna element 12 could be mounted directly on the outer surface of windshield 102 without the use of dielectric layer 116. It will also be recognized that antenna element 12 could be mounted directly on the inside surface of windshield 102, or formed using the other techniques previously described with respect to FIGS. 2 and 3, or even formed inside the windshield glass 102 itself, during the glass forming process, as long as the surface of the patterned layer of conducting material 112 is within the near field of antenna element 12.

As Shown in FIG. 19, the surface of the glass windshield 102 form an angle of approximately 30° with respect to the horizon (defined by the line $H_H$-$H_H$). For this application, it is desirable that the antenna structure 100, have a principal lobe or beam of radiation 118 for its H-plane radiation pattern in the angularly defined direction P toward the horizon at approximately $\theta$=60°, with $\phi$=90° However, it is also desirable that the TE radiation pattern of antenna structure 100 be directed parallel (i.e., tangent) to the surface of FSS 114 at an angle of $\theta$=90° in the direction along the x-axis, where $\phi$=0° and $\phi$=180°, and be directed in a generally horizontal directions as the angle $\phi$ varies between 0° and 180°. As will now be described, this can be accomplished patterning the conducting layer of material 112 so that the surface sheet reactance varies as a function of the direction away from antenna element along the surface of the patterned layer of conducting material 112.

Figure 20:
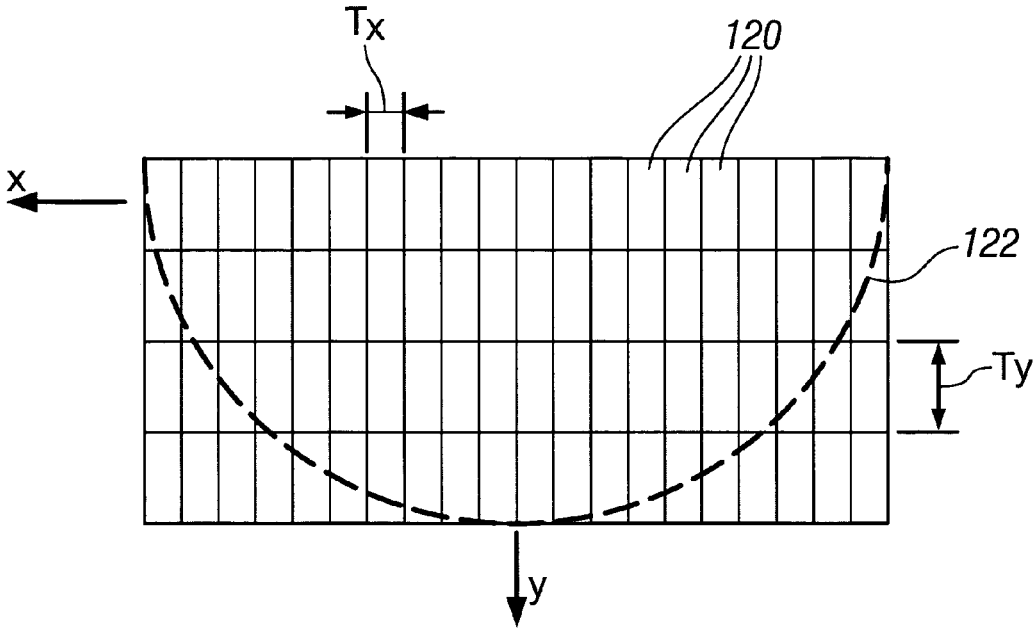
FIG. 20 shows a schematic layout of the non-uniform pattering of the layer of conducting material in the FSS of the antenna structure of FIGS. 18 and 19.

Referring now to FIG. 20, there is shown a schematic layout for patterning of the surface of the layer of conducting material 112 for the embodiment illustrated in FIGS. 18 and 19 to modify the TE radiation pattern as described above. The rectangular grid in FIG. 20 outlines the boundaries of rectangular shaped unit cells 120, which are distorted versions of the unit cell 60 containing the Jerusalem cross conductive element 61 (see FIG. 6A). The layout is formed by stretching the surface in the direction of the y-axis to form rectangular shaped unit cells 120 having a cell period $T_y$ in the y-direction, and a cell period $T_x$ in the x-direction.

To simplify the drawing of FIG. 20, only the boundaries of the rectangular shaped unit cells have been shown without the associated conducting elements 110. Each conducting element 110 takes the form of a distorted version of the Jerusalem cross conductive element 61, which of course is proportionally scaled in the x and y-directions in accordance with the related cell periods $T_x$ and $T_y$ of the rectangular shaped unit cells 120.

For the embodiment of the invention shown in FIGS. 18 and 19, it will be understood from the previous discussion associated with FIG. 17A, that the dimension $T_x$ of the cell period in the x-direction is selected to make the sheet reactance capacitive in the x-direction (with respect to the operating frequency of monopole antenna element 12) so that any radiation of the TE pattern, in directions of the positive and negative x-axis, will be at angles near $\theta$=90°, or toward the horizon. Likewise, the dimension $T_y$ of the cell period in the y-direction is selected to make the sheet reactance sufficiently inductive in the y-direction (with respect to the operating frequency of the monopole element 12) to adjust the direction of the principal lobe or beam 118 of the TE radiation pattern (in the H-plane) toward the horizon at $\theta$=60°, where $\phi$=90°.

Accordingly, by appropriately adjusting the patterning of FSS 114 in this fashion, the gain of the TE radiation pattern can be maximized in the range of angularly defined directions toward the horizon in front of the automobile 104, where $\phi$ varies between 0° and 180° and $\theta$=60°, even though the antenna structure 100 is mounted on the tilted surface of windshield 102.

Figure 21:
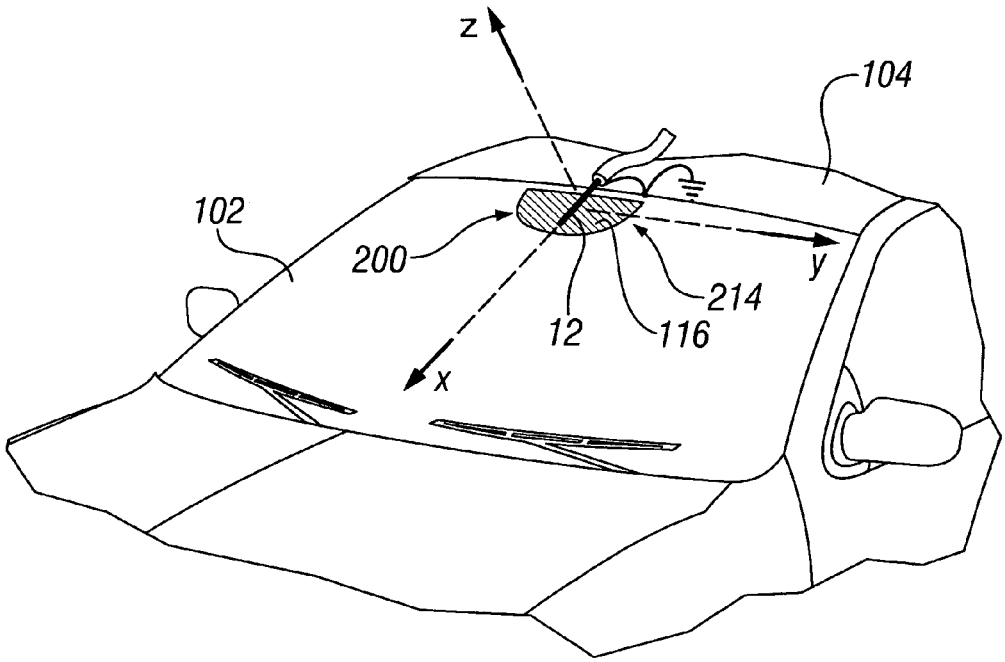
FIG. 21 is a perspective view of an antenna structure of the present invention, which is includes a parallel resonant FSS, and is adapted for use on an automobile windshield.

Referring now to FIG. 21, there is shown an additional embodiment of the invention for use on the windshield of an automotive vehicle. In this application, antenna structure 200 is show positioned near the center of the upper edge on the glass windshield 102 of an automobile 104. Monopole antenna element 12 is formed by the extended center conductor of coaxial cable 16 with its longitudinal axis directed along the x-axis. Monopole antenna element is positioned parallel to and proximate the upper surface of FSS 214. In this view, FSS 214 is not directly visible, but extends under a thin dielectric layer 116. The outer shield of coaxial cable 16 is shown schematically grounded to the metal surface of the body of automobile 104 near the center upper edge of the windshield 102.

Figure 22:
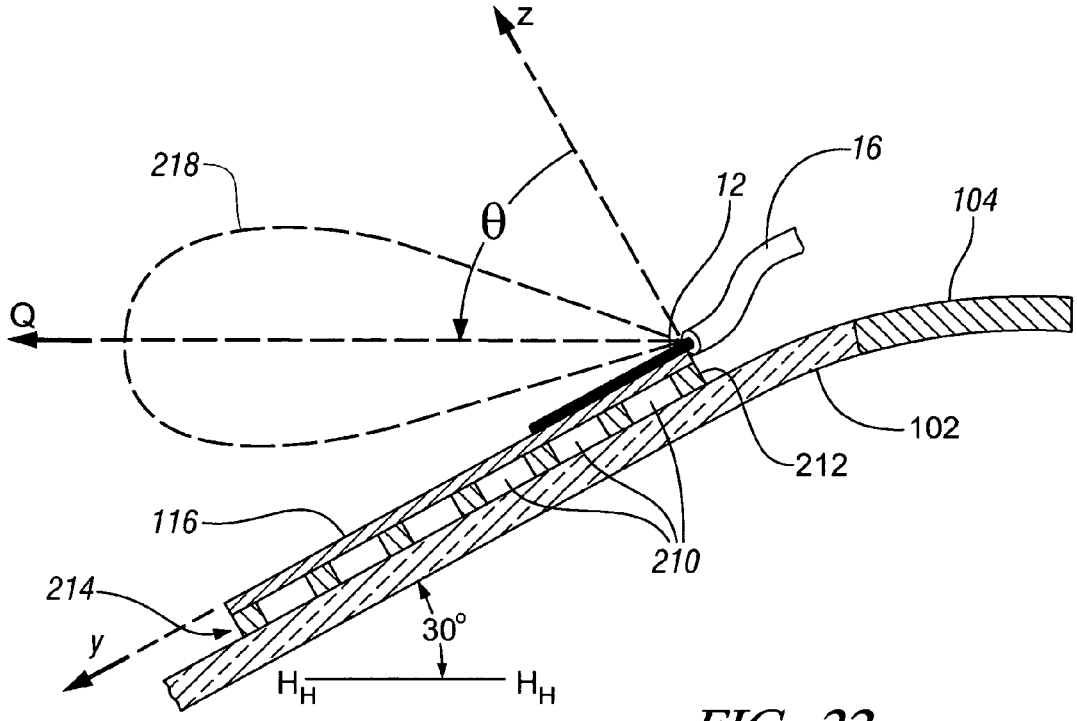
FIG. 22 is a cross-sectional view taken through the y-z plane of the antenna structure of FIG. 21.

As in the previous embodiment, FSS 214 takes the form of a semicircle having a radius of approximately one wavelength at the operating frequency of monopole antenna element 12, and is covered by the thin dielectric layer 116, which is used to space monopole antenna element 12 from the surface of the patterned layer of conducting material 212 of the 214 of FIG. 22. For this embodiment, FSS 214 is patterned as parallel resonant type FSS.

FIG. 22 shows a cross-sectional view of the antenna structure 200 of FIG. 21 taken through the x-z plane, where the thickness of the various layers are not to scale, and have been expanded for ease in illustration. In this embodiment, the patterned layer of conducting material 212 is formed directly on the outside surface of glass windshield 102, which supports the patterned layer of conducting material 212 having apertures 210.

As described previously for the embodiment of FIGS. 18 and 19, the patterned layer of conducting material 212 could also be formed on the opposite inside surface of the glass windshield 102, so that antenna element 12 could be mounted directly on the outer surface of windshield 102 without the use of dielectric layer 116. Antenna element 12 could also be mounted on the opposite surface of windshield 102, or formed using the other alternative techniques previously described with respect to FIGS. 2 and 3, or even inside the windshield glass 102 during the glass forming process, as long as the surface of the patterned layer of conducting material 212 is within the near field of antenna element 12.

As shown, the surface of the glass windshield 102 forms an angle of approximately 30° with respect to the horizon. For this application, it is also desirable that the antenna structure 200, have its E-plane radiation pattern (or gain) maximized in the angularly defined direction Q toward the horizon at approximately θ=60°, with ϕ=90°, as illustrated by the radiation lobe or beam designated by numeral 218. As with the embodiment illustrated in FIGS. 18 and 19, it is also desirable that the TM radiation pattern be maximized as much as possible in directions near parallel (i.e., tangent) to the surface of FSS 214 at angles near θ=90° along the positive and negative x-axis, where ϕ=0° and ϕ=180°, and also in directions generally horizontal as the angle ϕ varies between 0° and 180°. This can be accomplished by patterning the conducting layer of material 212 in a fashion such that the surface sheet reactance varies as a function of the direction away from antenna element 12 along the surface of the patterned layer of conducting material 212.

Similar to the previous embodiment, the layer of conducting material 212 can be patterned using rectangular shaped unit cells, but here, the unit cells take the form of distorted versions of the unit cells 70 having apertures in the form of inverse Jerusalem crosses 71 (see FIG. 7A). A layout for the boundaries for the unit cells similar to that depicted in FIG. 20 can be used for the present embodiment, but with the x and y-axes rotated counterclockwise by 90° so the longer sides of the rectangular shaped unit cells have the cell period $T_x$ in the x-direction, and the shorter sides have a cell period $T_y$ in the y-direction.

For this embodiment, the dimension $T_y$ of the cell period in the y-direction is selected to make the sheet reactance inductive in the y-direction (with respect to the operating frequency of monopole antenna element 12) to maximize as much as possible the gain of the TM pattern in directions of the positive and negative y-axis at angles near θ=90° (near the direction of the horizon). Likewise, the dimension $T_x$ of cell period in the x-direction is selected to make the sheet reactance sufficiently capacitive in the x-direction (with respect to the operating frequency of the monopole element 12) to maximize the gain of the E-plane radiation pattern in the angularly defined direction Q toward the horizon (i.e., where θ=60°, and ϕ=90°).

Accordingly, by appropriately adjusting the patterning of FSS 214, and its associate resonant frequency relative to the selected frequency of operation of antenna element 12 in this fashion, the gain of TM radiation pattern can maximized in the range of angularly defined directions toward the horizon in front of the automobile 104, for angles of ϕ varying between 0° and 180°, at angles near θ=90°, even though the antenna structure 200 is mounted on the tilted surface of windshield 102.

Figure 23:
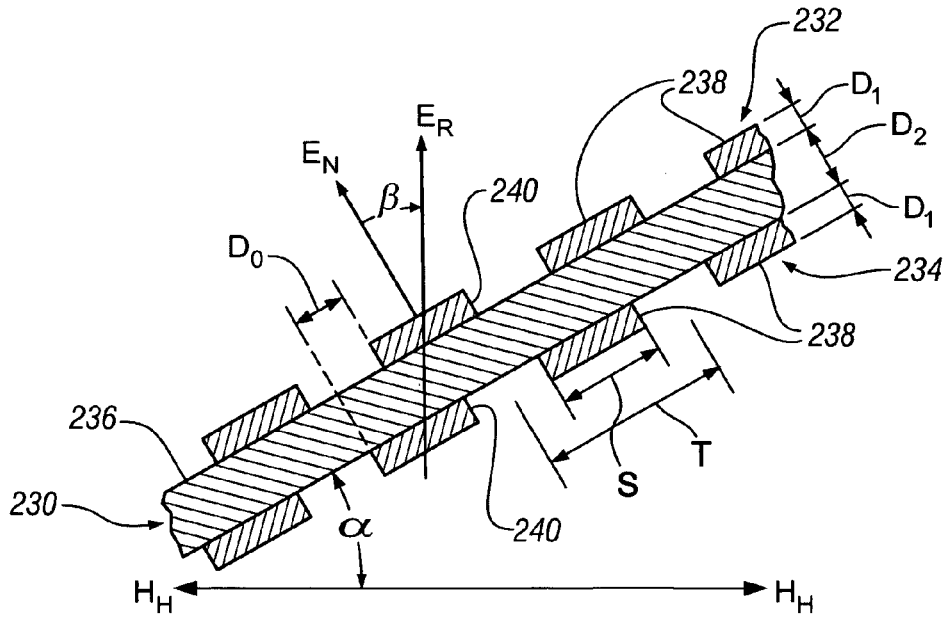
FIG. 23 illustrates a FSS having two patterned layers of conducting material on opposite sides of a dielectric layer used for adjusting the polarization of the TM radiation patterns of antenna structures of the present invention.

Referring now to FIG. 23, there is shown a cross-sectional view of a FSS 230, which includes patterned layer of conducting material 232, and an additional secondary patterned layer of conducting material 234 formed on opposite surfaces of a layer of dielectric material 236. As shown, the layer of dielectric material 236 is tilted at an angle α with respect to the horizon represented schematically by horizontal line $H_H$-$H_H$.

The patterned layer of conducting material 232 and the secondary patterned layer of conducting material 234 have similar patterning, and can take the form of either separate conductive elements 238, used in forming capacitive or series resonant type FSSs. Alternatively, the patterned layers of conducting material 234 and 236 could have apertures 240, in which case the conductive elements 238 would be connected such as those of the previously discussed inductive or parallel resonant type FSSs.

As illustrated in this fashion, FSS 230 is intended to depict a FSS having two patterned layers of conducting material 232 and 234 that can be formed either as connected conductive elements 238 with apertures 240, or as separated conductive elements 238 formed on dielectric layer 236.

If the secondary patterned layer of conducting material 234 were absent from the structure of FSS 230, the patterned layer of conducting material 232 would support electric fields having a polarization in the direction $E_N$, normal to the surface of FSS 232. The applicants have found that by including the secondary patterned layer of conducting material 234 in the structure of FSS 232, the direction of polarization of the electric fields supported by surface of FSS 230 can be adjusted or rotated from the normal direction.

As shown in FIG. 23, if the secondary patterned layer of conducting material 234 is shifted relative to patterned layer of conducting material 232 the in a direction tangent to the surface of FSS 230, by an offset distance designated as $D_0$, the direction of the polarization of the electric fields supported by the surface will be rotated from the normal direction by the angle β, which is shown by the electric field component $E_R$, which has its direction of polarization defined by a line passing through the centers of conducting elements 238 that overlap on opposite surfaces of dielectric layer 236.

In what follows, S represents the approximate width of the conductive elements 238, and T represents the unit cell period of the patterned layers of conducive material 232 and 234, all of which are measured in the plane defined by the normal to the surface of FSS 232 and the line in the direction of the offset distance $D_0$. Given that the thickness $D_1$ of the patterned layers of conducting material 232 and 234 is much less than the thickness $D_2$ of the dielectric layer 236, the angle β is approximately given by the expression $\beta=\tan^{-1}(D_0/D_2)$.

When the offset distance $D_0$ is varied from zero to (T-S), the angle β will respectively vary from zero to $\tan^{-1}(D_0/D_2)$. The angle β can also be made to vary from zero to $-\tan^{-1}(D_0/D_2)$, by reversing the direction in which the offset distance $D_0$ is varied along the surface, from zero to (T-S) (i.e., by shifting or skewing the conducting elements 238 on the lower surface of dielectric layer 236 in an upwardly rather than downwardly direction along the surface of dielectric layer 326).

As will be understood by those skilled in the art, the ability to rotate the polarization direction of the electric field $E_R$, as described above, provides a means for adjusting or rotating the polarization of the TM radiation pattern of antenna structures of the present invention, which is particularly useful when such antenna structures are formed on surfaces tilted with respect to the horizon.

Consider for example, the embodiment for the antenna structure 100 shown in FIGS. 18 and 19. Because of the 30° tilt of windshield 102, the electric field of the TM radiation pattern near the surface of FSS 144 (at angles of θ near 90°) will be polarized parallel to the z-axis, or at an angle of 60° with respect to the horizon (line $H_H$-$H_H$). By including a secondary patterned layer of conducting material in the structure of FSS 114, as described in FIG. 23, and shifting or skewing it as described above, the electric field of the TM radiation pattern near the surface of FSS 114 can be rotated to have a polarization in the vertical direction, i.e. in a direction perpendicular to the horizon (i.e., line $H_H$–$H_H$).

Likewise, by including a skewed or offset secondary patterned layer of conducting material in the structure of FSS 214, the polarization of the TM radiation pattern of antenna structure 200 shown in FIGS. 21 and 22 can also be rotated to the vertical direction near the surface of FSS 214, for angles near θ=90°.

Thus, the present invention provides a means for modifying or rotating the polarization of the TM radiation pattern of antenna structures formed on surfaces tilted with respect to the horizon. This can be advantageous for automotive vehicle applications where receiving or transmitting vertically polarized radiation is desirable.

Figure 24:
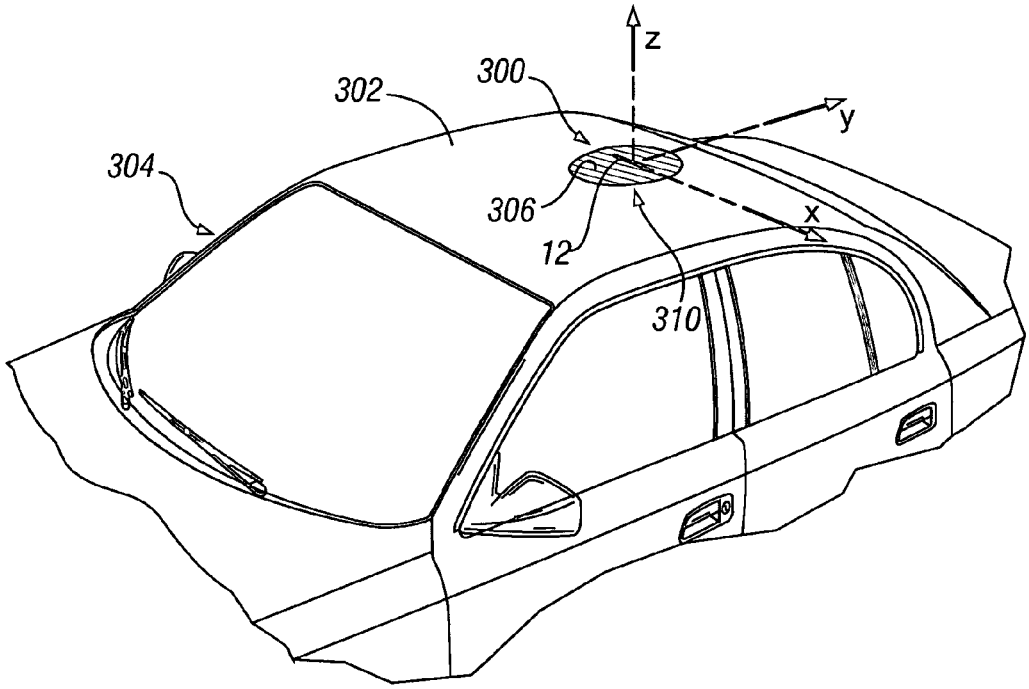
FIG. 24 is a perspective view of an antenna structure of the present invention adapted for use on the metallic roof structure of an automobile.

Turning now to FIG. 24, there is shown a further embodiment of the present invention in perspective view. Antenna structure 300 is formed on the metallic roof section 302 of an automobile designated generally by numeral 304. Antenna structure 300 includes a monopole radiating element 12 disposed on a dielectric spacer layer 306, which covers a FSS 310 not visible in this view.

Figure 25A:
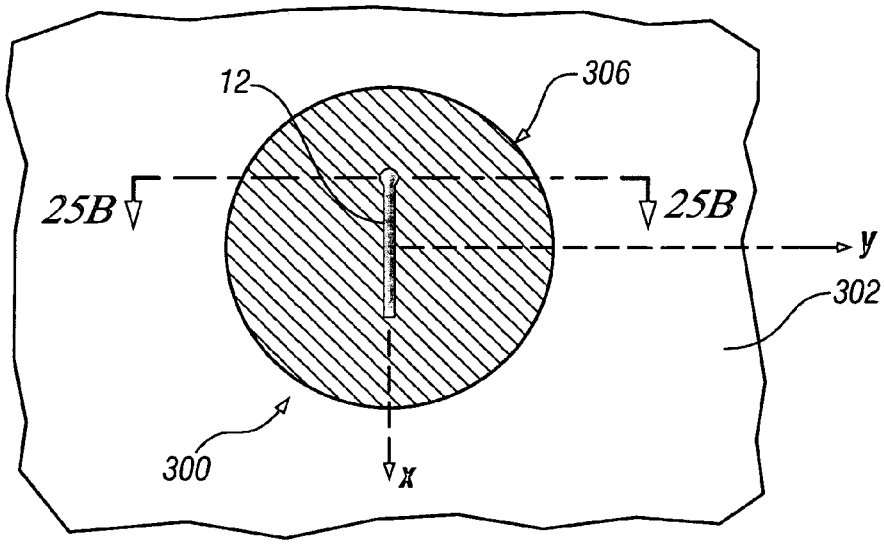
FIGS. 25A and 25 B show respectively, a plan view of the antenna structure of FIG. 24, and a cross-sectional view along line 25B-25B of the antenna structure in FIG. 25A.

FIG. 25A shows a top plan view of the antenna structure 300 of FIG. 24. In this embodiment, antenna element 12 is shown approximately centered on the circular shaped dielectric spacer layer 306. The radius of the dielectric spacer layer 306 (and the hidden FSS 310) is preferably one or two wavelength at the operating frequency of monopole antenna element 12, although dielectric spacer layer 306 could be reduced in size, as long as it prevents antenna element 12 from contacting the conducting surface of FSS 310.

Figure 25B:
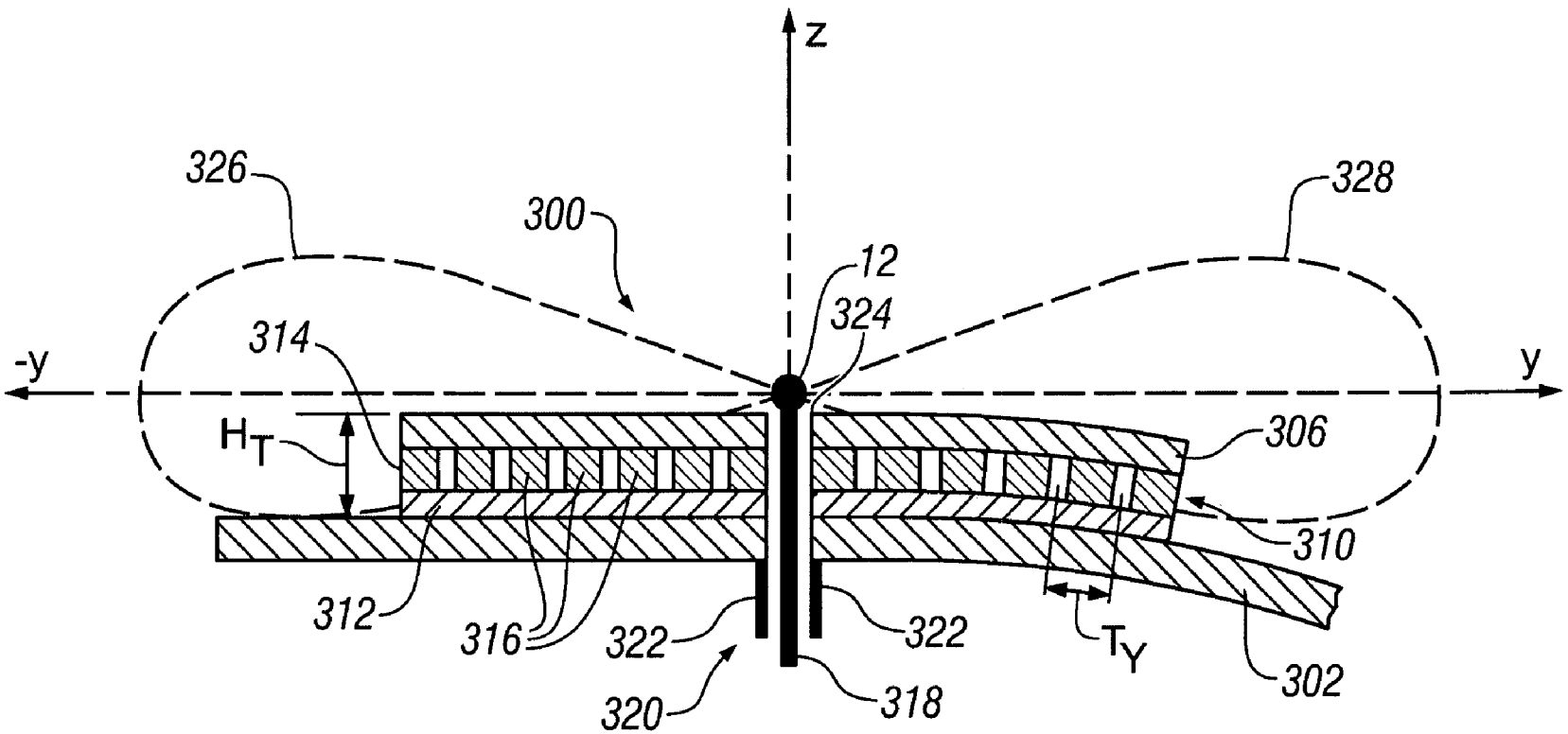

FIG. 25B shows a cross-sectional view of the antenna structure 300 of FIG. 25A taken along the section line labeled 25B-25B. It will be noted that in this embodiment, the dielectric layer 312 is disposed directly on the metallic surface 302 of the automobile roof. The patterned layer of conducting material 314, having conducting elements 316, is then formed on the upper surface of the dielectric layer 312 to complete the formation of FSS 310, with dielectric layer 312 electrically insulating the patterned layer of conducting material 314 from the metallic roof surface 302. In this embodiment, FSS 310 is of the series resonant type, with each separate conducting element 316 having the form of a Jerusalem Cross 61 illustrated in FIG. 6A.

Monopole antenna element 12 is connected to the center conductor 318 of coaxial cable, generally designated as numeral 320. Center conductor 318 passes through a small feed hole 324 formed through the layer of conducting material 314, the FSS 310, and the dielectric spacer layer 306 to make contact with antenna element 12. The center conductor 318 can be soldered to antenna element 12, or center conductor 318 can be made sufficiently long so it can be bent over after exiting hole 324 to form antenna element 12. The outer shield conductor 322 of coax cable 320 is electrically connected to the metallic surface 302 of the automobile by soldering or other suitable means.

This particular antenna structure 300 can be formed to have a very low profile, with height $H_T$ approaching 1/50 of a wavelength at the frequency of operation of antenna element 12. This is due to the presence of FSS 310 between antenna element 12 and the metallic roof structure 302 of automobile 304. The sheet reactance of FSS 310 prevents the metallic roof structure 302 from tending to short out the operation of closely spaced antenna element 12.

For the roof mounted configuration of antenna structure 300, the desired or ideal H-plane radiation pattern would be omni-directional with its principal radiation lobes or beams 326 and 328 being directed in essentially opposite directions along the negative and positive y-axis.

If FSS 310 were mounted on a completely horizontal metal surface, the layer of conducting material 314 would be patterned in a uniform fashion such that the propagation of TE surface waves would be enhanced at the frequency of operation of antenna element 12 (see region 62 of FIG. 6C). The TE surface waves would then propagate over the surface of FSS 310 in a direction along the y-axis and radiate in a direction close to the surface from the edges to increase the low angle TE radiation (horizontally polarized), which tends to be reduced by the presence of the metallic roof structure 302.

As shown in FIG. 25B, the antenna structure 300 is not mounted on a completely horizontal surface. FSS 310 extends basically in a horizontal direction, except for a portion along the positive y-axis, where it bends downwardly due to the slope of the metallic roof structure 302. If the layer of conducting material 314 of antenna structure 300 were patterned in all directions to have square shaped unit cells, TE surface waves propagating in the direction of the positive y-axis would follow the downward curvature of the surface of FSS 310 before radiating close to or tangent to the surface at the edge of FSS 310. This would distort the H-plane radiation pattern from the desired omni-directional behavior.

From the foregoing description, it will be recognized that by appropriately pattering the layer of conducting elements 314 in a non-uniform fashion, the principal lobe or beam 328 can be adjusted to have its maximum along the positive y-axis to maintain the desired omni-directional behavior of the H-plane radiation pattern. This is accomplished by appropriately increasing the period $T_y$ of the unit cells on that portion of FSS 310 positioned on the side of the y-axis having positive y-coordinates, to form rectangular shaped unit cells similar to the layout of FIG. 20. As indicated above, the unit cells on that portion of FSS 310 on the side of the y-axis having negative y-coordinates would remain square (i.e., with $T_x=T_y$) to support the propagation of TE surface waves along the surface of FSS 310 in the direction of the negative y-axis.

Accordingly, the present invention enables the adjustment of the radiation patterns of antenna structures formed on non-planar surfaces, by patterning different portions of the layer of conducting material 314 of the FSSs in different ways.

The above embodiments of the invention have been illustrated by way of a monopole wire antennas used as the antenna elements in the disclosed antenna structures, It will be recognized by those skilled in the art that any other known antenna elements, such as dipoles, loops, slots, notches, patches, and arrays of such elements can easily be substituted for the monopole antenna elements in forming antenna structures that operate in accordance with the principles of the present invention.

While the invention has been described by reference to certain preferred embodiments and implementations, it should be understood that numerous changes could be made within the spirit and scope of the inventive concepts described. Accordingly, it is intended that the invention not be limited to the disclosed embodiments, but that it have the full scope permitted by the language of the following claims.

The invention claimed is:

1. Method for fabricating an antenna structure having adjustable radiation characteristics, the method comprising:

providing a frequency selective surface including a patterned layer of conducting material having electromagnetic properties that vary as a function of frequency, the frequency selective surface further including a layer of dielectric material having first and second opposing surfaces, the patterned layer of conducting material being disposed on the first surface of the layer of dielectric material, the frequency selective surface further comprising a secondary patterned layer of conducting material applied to the second surface of the layer of dielectric material, wherein the patterned layer of conducting material and secondary patterned layer of conducting material each comprise a similar pattern of conductive elements;

positioning an antenna element proximate to the frequency selective surface to promote near field coupling of electromagnetic energy between the antenna element and the patterned layer of conducting material, when the antenna element is operated at a selected frequency;

structuring the patterned layer of conducting material to have specific electromagnetic properties at the selected frequency of operation of the antenna element to obtain a predetermined adjustment of the radiation characteristics of the antenna structure, wherein the radiation characteristics of the antenna structure are defined by TE and TM radiation patterns, each having respective electric and magnetic field components; and shifting the patterned layer of conducting material with respect to the secondary patterned layer to provide an offset between the conducting elements on the opposing surfaces of the dielectric material in a direction tangent to one of the opposing surfaces, whereby the amount of offset determines polarization direction for the electric field of the TM radiation pattern.

2. Method for fabricating an antenna structure having adjustable radiation characteristics, the method comprising:

providing a frequency selective surface including a patterned layer of conducting material, the patterned layer of conducting material having a pattern, which determines electromagnetic properties of the frequency selective surface that vary as a function of frequency;

positioning an antenna element proximate to the frequency selective surface to promote near field coupling of electromagnetic energy between the antenna element and the patterned layer of conducting material, when the antenna element is operated at a selected frequency; and varying the pattern of the patterned layer of conducting material to have specific electromagnetic properties at the selected frequency of operation of the antenna element to obtain a predetermined adjustment of the radiation characteristics of the antenna structure.

3. The method of claim 2, wherein the antenna element comprises a wire monopole formed by an elongate conducting wire.

4. The method of claim 3, wherein the wire monopole has a longitudinal axis extending substantially parallel to the frequency selective surface.

5. The method of claim 2, wherein the antenna element comprises a tab monopole formed by an elongate strip of conducting material.

6. The method of claim 2, wherein the tab monopole has a longitudinal axis extending substantially parallel to the surface of the frequency selective surface.

7. The method of claim 2, wherein the frequency selective surface is planar.

8. The method of claim 2, wherein the frequency selective surface is non-planar.

9. The method of claim 2, wherein the frequency selective surface further includes a layer of dielectric material having first and second opposing surfaces, and the patterned layer of conducting material is disposed on the first surface of the layer of dielectric material.

10. The method of claim 9, wherein the patterned layer of conducting material is interposed between the antenna element and the layer of dielectric material.

11. The method of claim 9, wherein the layer of dielectric material is interposed between the antenna element and the patterned layer of conducting material.

12. The method of claim 9, further comprising applying a secondary patterned layer of conducting material to the second surface of the layer of dielectric material.

13. The method of claim 9, wherein the patterned layer of conducting material and the secondary patterned layer of conducting material each comprise a similar pattern of conductive elements.

14. The method of claim 2, wherein the radiation characteristics of the antenna structure are defined by TE and TM radiation patterns, each respectively representing antenna gain for TE and TM polarized radiation as a function of angularly defined direction away from the antenna structure, the patterned layer of conducting material being structured to provide a resonant frequency that maximizes antenna gain for at least one of the TE and TM radiation patterns in a predetermined angularly defined direction.

15. The method of claim 2, wherein the patterned layer of conducting material has a surface sheet reactance varying in different directions away from the antenna element along the patterned layer of conducting material.

16. The method of claim 15, wherein the radiation characteristics are defined by TE and TM radiation patterns, each respectively representing antenna gain for TE and TM polarized radiation as a function of angularly defined direction away from the antenna structure, the patterned layer of conducting material being structured to provide a varying surface sheet reactance that maximizes antenna gain for at least one of the TE and TM radiation patterns for a predetermined range of angularly defined directions.

17. The method of claim 16, wherein the patterned layer of conducting material has a plurality of regions, each region being formed of unit cells, the unit cells forming each region being of a different shape.

18. The method of claim 15, wherein the patterned layer of conducting material is formed as a plurality of rectangular shaped unit cells, each unit cell containing similarly shaped conductive elements.

* * * * *